United States Patent [19]

Kramer

[11] Patent Number: 5,076,293

[45] Date of Patent: Dec. 31, 1991

[54] PROCESS AND APPARATUS FOR THE TREATMENT OF TOBACCO MATERIAL

[75] Inventor: Anatoly I. Kramer, Winston-Salem, N.C.

[73] Assignee: R. J. Reynolds Tobacco Company, Winston-Salem, N.C.

[21] Appl. No.: 519,841

[22] Filed: May 10, 1990

Related U.S. Application Data

[63] Continuation-in-part of Ser. No. 367,589, Jun. 19, 1989, abandoned.

[51] Int. Cl.[5] ..... A24B 3/18; A24B 15/18

[52] U.S. Cl. ..... 131/291; 131/296; 131/303; 131/304; 131/305; 131/306

[58] Field of Search ..... 131/290, 296, 297, 298, 131/300, 301, 302, 306, 303, 304, 305

[56] References Cited

U.S. PATENT DOCUMENTS

| | | |
|---|---|---|
| 2,128,043 | 8/1938 | Garner . |
| 2,428,241 | 9/1947 | Pootjes . |
| 2,538,320 | 1/1951 | Mylting . |
| 2,672,370 | 3/1954 | Jones et al. . |
| 3,118,575 | 1/1964 | McCauley . |
| 3,130,879 | 4/1964 | Messing . |
| 3,353,723 | 11/1967 | Wieleba . |
| 3,393,944 | 7/1968 | Reintjes . |
| 3,524,451 | 8/1970 | Fredrickson . |
| 3,524,452 | 8/1970 | Moser et al. . |
| 3,556,355 | 1/1971 | Ruiz . |
| 3,683,937 | 8/1972 | Fredrickson et al. . |
| 4,033,467 | 7/1977 | Bewley et al. . |
| 4,047,901 | 9/1977 | Baron et al. . |
| 4,153,063 | 5/1979 | Roselius et al. . |
| 4,180,188 | 12/1979 | Aonuma et al. . |
| 4,221,307 | 9/1980 | Peterson . |
| 4,228,932 | 10/1980 | Aonuma et al. . |
| 4,235,250 | 11/1980 | Utsch . |
| 4,235,354 | 11/1980 | Aonuma et al. . |
| 4,258,729 | 3/1981 | de la Burde et al. . |
| 4,333,483 | 6/1982 | de la Burde et al. . |
| 4,397,731 | 8/1983 | Warzel . |
| 4,427,135 | 1/1984 | MacKay et al. . |
| 4,506,682 | 3/1985 | Muller . |
| 4,531,529 | 7/1985 | White et al. . |
| 4,554,932 | 11/1985 | Conrad et al. . |
| 4,561,453 | 12/1985 | Rothchild . |
| 4,727,889 | 3/1988 | Niven, Jr. et al. . |
| 4,744,375 | 5/1988 | Denier et al. . |
| 4,791,942 | 12/1988 | Rickett et al. . |
| 4,821,749 | 4/1989 | Toft et al. . |

FOREIGN PATENT DOCUMENTS

| | | |
|---|---|---|
| 0280817 | 9/1988 | European Pat. Off. . |
| 0323699 | 7/1989 | European Pat. Off. . |
| 0328676 | 8/1989 | European Pat. Off. . |
| 1444309 | 7/1976 | United Kingdom . |

OTHER PUBLICATIONS

"The Standardization of Advanced Ceramics", Schneider, Jr. et al, *Adv. Cer. Mat.*, vol. 3, p. 442 (1988).

Stephen C. Lattin, Tough Valves with Ceramics, Applied Technology, Reprinted from Machine Design, Penton Publishing, Inc., Cleveland, OH, Aug. 6, 1987.

Ceramic Composite Outperforms Steel in High-Pressure Valves, Advanced Ceramic Materials, vol. 2, No. 1, 1987.

Coors Thick Film Substrates-Design Standard 49, Coors Porcelain Company, 1982.

(List continued on next page.)

*Primary Examiner*—V. Millin

[57] ABSTRACT

Process and apparatus for the treatment of tobacco material and other biological materials includes a mechanism comprising a dynamic seal having components having cooperating movable surfaces for sealing a treatment chamber that substantially prevents the passage of fluid at the treatment chamber pressure during movement of the components for introducing material into and removing material from the chamber. The seal components preferably comprise advanced structural ceramic components having a hardness of at least 900 kg/mm$^2$ and a flatness of at least 70 microinches. The process is preferably conducted at supercritical gaseous conditions.

99 Claims, 9 Drawing Sheets

OTHER PUBLICATIONS

Fine Ceramic Rotary Control Valves for the Control of: Corrosive, Abrasive and Erosive Medias; Fujikin International, Inc., Japan '88.5.2,0(1).

Properties of Coors Ceramics 12/81.

WABCO Fluid Power Catalog, SC-310, Rev. Sep., 1987.

Status of the Continuous Extraction of Solids with Supercritical Gases; R. Eggers et al., Article from Trade Journal "Fette . Seifen . Amstrichmittel," No. 9, 1986, pp. 344-351.

Feed Systems for Pressure Reactors Concepts and Realization, Rainer Reimert, Article from Chem.-Ing-.-Tech, 53 (1981), pp. 344-351.

High Pressure Extraction of Oil Seed, R. Eggers et al., JAOCS, vol. 62, No. 8 (Aug. 1985).

On the Situation of Continuous Extraction of Solids by Means of Supercritical Gases, R. Eggers, Technische Universität Hamburg-Harburg, West Germany.

Fluid Extraction of Hops, Spices, and Tobacco with Supercritical Gases, Peter Hubert et al., Angew. Chem. Int. Ed. Engl. 17, 710-715 (1978).

SUPPLY
SURGE VESSEL
EXTRACT SEPARATOR
EXTRACT
CONSTANT TEMP. BATH
PREHEAT HIGH PRESS. FLUID
SOLVENT RECOVERY SYSTEM
METERING PUMP
H.P. LIQUID PUMP
HIGH PRESS. COMPRESSOR
FROM PORT R
REG. V
REL. V

PROCESS AND APPARATUS FOR THE TREATMENT OF TOBACCO MATERIAL

CROSS REFERENCE TO A RELATED APPLICATION

This application is a continuation-in-part of copending application Ser. No. 07/367,589, filed June 19, 1989, now abandoned the disclosure of which is incorporated herein by reference.

BACKGROUND OF THE INVENTION

The present invention relates to a process and apparatus for treating a material with a fluid, and in particular, for changing the chemical and/or physical nature of that material under controlled pressure and temperature conditions. Of particular interest is a process and apparatus for treating a tobacco material with a fluid at pressures greater than ambient pressures.

Popular smoking articles, such as cigarettes, have a substantially cylindrical rod-shaped structure and include a charge of smokable material, such as shreds or strands of tobacco material (i.e., in cut filler form), surrounded by a paper wrapper, thereby forming a tobacco material rod. It has become desirable to manufacture a cigarette having a cylindrical filter element aligned in an end-to-end relationship with the tobacco material rod. Typically, a filter element includes cellulose acetate tow circumscribed by plug wrap, and is attached to the tobacco material rod using a circumscribing tipping material.

Tobacco material undergoes various processing steps prior to the time that it is used for cigarette manufacture. Oftentimes, a tobacco material is chemically and/or physically altered to modify its flavor and smoking characteristics.

In certain circumstances, it may be desirable to selectively remove substances, such as nicotine, from a tobacco material. Various processes directed toward removing nicotine from tobacco material have been proposed. Many of such types of processes are discussed in European Patent Application Nos. 280817 and 323699, and in U.S. Pat. Nos. 4,153,063 to Roselius et al. and 4,744,375 to Denier et al.

In other circumstances it may be desirable to increase the filling capacity of a tobacco material. In particular, it may be desirable to decrease the density of an aged tobacco material by expanding the tobacco material thereby reducing the weight of the tobacco material employed in the manufacture of each cigarette. Many so-called expansion processes for increasing the filling capacity of tobacco material are set forth in U.S. Pat. Nos. 3,524,451 to Fredrickson; 3,524,452 to Moser et al; 3,683,937 to Fredrickson et al; 4,235,250 to Utsch; 4,791,942 to Rickett et al; 4,561,453 to Rothchild; and 4,531,529 to White et al.

It would be desirable to provide a process and apparatus for efficiently and effectively altering the chemical and/or physical nature of a material, such as a tobacco material, wherein a continual flow of material can be continuously contacted with a treatment fluid at pressures significantly above ambient pressure.

SUMMARY OF THE INVENTION

The present invention provides a process and an apparatus for treating a material by altering its character, and in particular, by altering the chemical and/or physical nature of a material. By altering the chemical nature of a material is meant either i) the removal of substances from or addition of substances to a material such as through, respectively, extraction of substances or impregnation of substances, or ii) reactive change of substances in a material brought about by contact with selected reactants, heat, or pressure. By altering the physical nature of a material is meant the change in form of treated material when compared to an untreated material, such as expansion of the material or even explosive shattering. As will be explained, the present invention includes altering the chemical nature of a material without altering its physical characteristics to a significant degree, such as by way of specific example, through extraction of cigarette cut filler or ammoniation of cigarette cut filler. The present invention also includes altering the physical characteristics of materials without altering the chemical characteristics to a significant degree, such as by expanding cigarette cut filler or disrupting the cell structure of biological components. Finally, the present invention can be employed to combine a number of treatments to alter both chemical and physical characteristics of materials.

The present invention relates to an apparatus for treating a material under controlled pressure and temperature conditions. Such apparatus includes a pressure chamber having a treatment zone where the material to be treated is subjected to controlled pressure and temperature conditions. Typically, the material is contacted with a fluid under controlled pressure and temperature conditions different from ambient pressure and temperature conditions.

In one aspect, the apparatus includes an input mechanism for introducing material to a pressure chamber while the pressure and temperature of fluid within the chamber is controlled. In another aspect, the apparatus includes an output mechanism, which can be similar to the input mechanism, for removing material from a pressure chamber while the pressure and temperature of fluid within the chamber is controlled. In preferred aspects of the present invention, the pressure chamber is maintained at controlled pressure conditions that are significantly different from ambient pressure.

The input and output mechanisms each include a dynamic seal and provide, respectively, for the passage of material into and out of the pressure chamber without significant leakage of fluid being experienced, either into or out of the chamber. More specifically, each such dynamic seal comprises cooperating movable surfaces of two components in intimate contact. The components are provided from materials of sufficient hardness and mechanical strength and the contacting surfaces of these components are finished to a flatness and smoothness to obtain a sufficiently low coefficient of friction and to enable one surface to move relative to the other (i) without significant deformation under high compressive or clamping forces, and (ii) while preserving an area of contact sufficiently great to prevent significant fluid leakage between these surfaces.

Preferred dynamic seals can be used to effectively seal pressure chambers maintained at pressures greater than 50 psig, normally greater than 100 psig, often greater than 350 psig, and even greater than 1,000 psig. For example, one component of the input mechanism seal is fixed to the input mechanism (e.g., using an adhesive or brazing technique or other technique known to those skilled in the art) so that fluid leakage between that mechanism and the seal component is substantially eliminated. The other component of the input mechanism seal is fixed to the pressure chamber (e.g., using an adhesive or brazing technique or other technique known to those skilled in the art) so that fluid leakage between the seal component and the surface to which the seal component is attached is substantially eliminated. The two surfaces of the seal components, when in sliding contact under a sufficient clamping force, provide a dynamic seal located between the input mechanism and the pressure chamber. Such a dynamic seal substantially prevents fluid leakage between the contacting surfaces while providing for the passage of material across a pressure boundary and into the pressure chamber. Still more specifically, such surfaces can be provided by advanced structural ceramic materials, which most preferably are in plate form.

The output mechanism includes a seal component of similar construction to that of the input mechanism and that is in intimate contact with a seal component fixed to the pressure chamber. The two surfaces of these seal components, when placed together under a sufficient clamping force, provide a dynamic seal between the output mechanism and the pressure chamber. Such a dynamic seal substantially prevents fluid leakage between the contacting surfaces of the seal while providing for the passage of material across a pressure boundary and out of the pressure chamber.

The present invention also relates to a process for treating a material under controlled conditions of pressure, which typically is a relatively high pressure, although controlled conditions of low pressure (e.g. vacuum conditions) are contemplated. In any event, the process of the present invention can be conducted at pressures significantly different from ambient pressure. The process typically includes the steps of introducing a material to be treated through an input mechanism into the treatment zone of a pressure chamber, introducing a treatment fluid into the chamber, and maintaining the fluid under controlled conditions of pressure. The process is capable of being conducted such that treatment fluid is introduced into the pressure chamber and maintained under controlled conditions of pressure prior to and during the introduction of the material to be treated into the chamber. Such a process desirably includes the use of a pressure chamber having input and output mechanisms of the type previously described. The input and output mechanisms may be the same (e.g., the material to be treated enters and the treated material exits the chamber through a single mechanism) or different (e.g., the material enters and exits through separate input and output mechanisms, respectively). Typically, maintaining the fluid in the treatment zone under controlled conditions of pressure includes introducing a fluid into and removing a fluid from the chamber under controlled pressure conditions such that substantially stable conditions of enhanced pressure are maintained in the chamber. The process can be conducted in either batch or continual modes.

In a specific continual process embodiment, the material to be treated is continually introduced into the pressure chamber maintained at controlled pressure conditions through aligned apertures in a dynamic seal comprising contacting component surfaces of advanced structural ceramic materials. These surfaces move relative to one another to provide aligned apertures without significant fluid leakage between the surfaces. By continual is meant the regular, frequent, and recurrent introduction of discreet portions of material into or removal of discreet portions of material from a treatment chamber in which treatment of material occurs in a continuous or uninterrupted fashion (i.e., material remains in the pressure chamber while discreet portions of material are introduced into the chamber or removed therefrom).

In a specific batch embodiment, the material to be treated is introduced into a pressure chamber at uncontrolled, usually ambient, pressure conditions, and sealed prior to the introduction of treatment fluid. Thereafter, the chamber is maintained at controlled conditions of pressure employing a dynamic seal comprising contacting surfaces of advanced structural ceramic materials that are movable relative to one another without resulting in any significant fluid leakage between those surfaces.

The process and apparatus of the present invention are useful for processing a wide variety of materials, including biological materials such as plant materials or others. The apparatus enables these materials to be processed at a variety of controlled temperature and pressure conditions. For example, controlled pressure conditions can range from a constant pressure condition to conditions of rapid pressure change. Of particular interest is the processing of tobacco materials at controlled pressure and temperature conditions. The process of the present invention provides a manner for promoting expansion of a material such as a tobacco material, extracting selected substances from a material, impregnating a material with selected substances, contacting a material with reactants that change the composition of selected components of that material, explosively disintegrating the internal structure of a material to reduce its particle size, and employing enhanced extraction techniques of biological materials by using a cell rupture technique. Also of particular interest is a process for treating a material such as tobacco material in cut filler form, especially in a continual manner, such that its form as cut filler is not destroyed.

DESCRIPTION OF THE PREFERRED EMBODIMENTS

Figure 1:
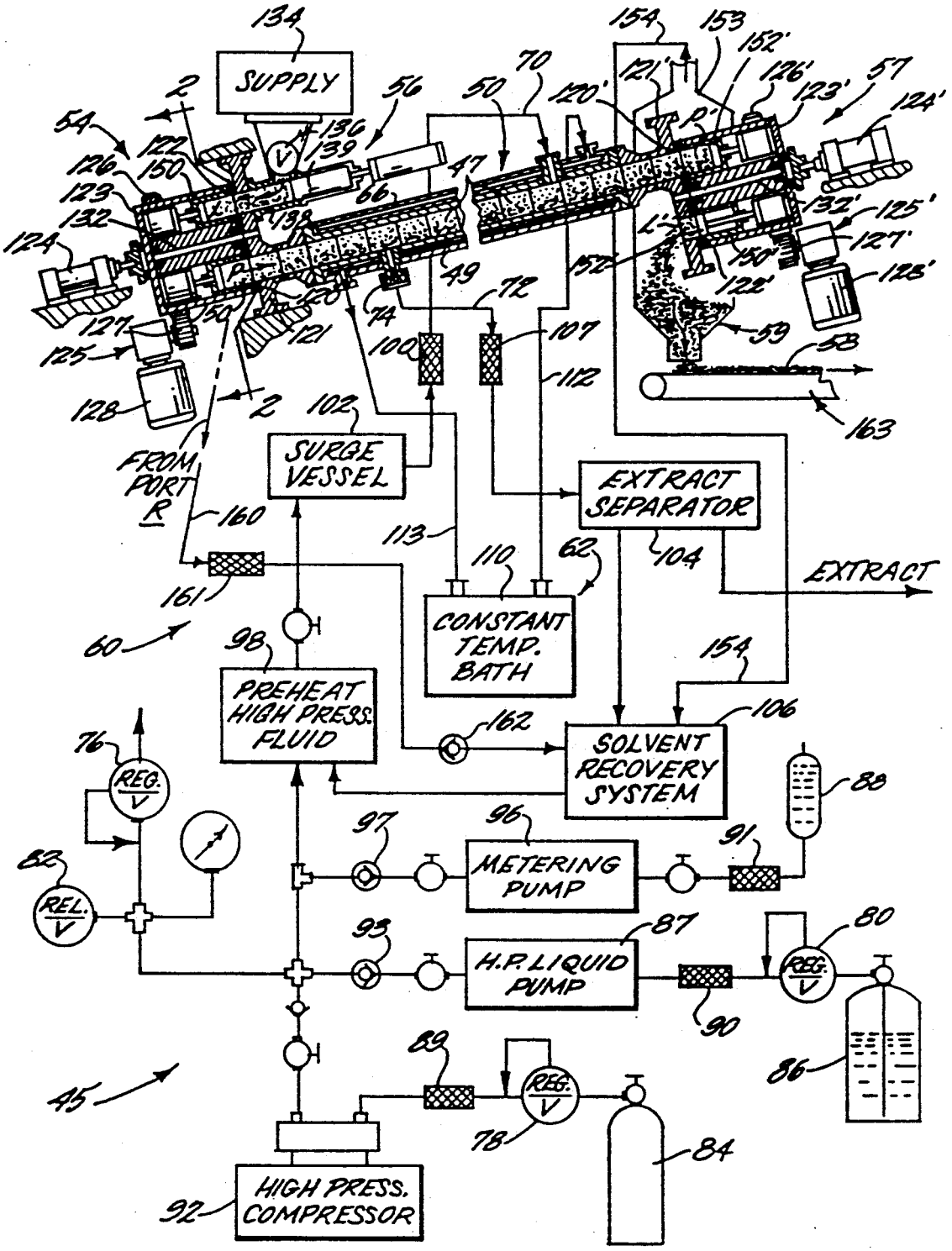
FIG. 1 illustrates in partial longitudinal section a side view of a representative apparatus of the present invention for treating a continual flow of a material, including process flow diagrams for treatment fluid and auxiliary equipment.

The process and apparatus of the invention can best be understood with reference to several specific embodiments of the apparatus that are illustrated in the drawings and have been adapted to perform specific processes. While the invention will be so described, it should be understood that the invention is not intended to be limited to the embodiments illustrated in the drawings. On the contrary, the invention includes all alternatives, modifications, and equivalents that may be included within the spirit and scope of the invention as defined by the appended claims.

Referring more particularly to the drawings, FIGS. 1 through 4 illustrate an apparatus 45 for extracting substances from a continual flow of tobacco material 47 moving through an extraction zone 49 of a pressure chamber 50 that is maintained at controlled conditions of high pressure. As illustrated in FIG. 1, the apparatus includes a high pressure treatment chamber 50; an input mechanism 54 for receiving tobacco material at ambient pressure from a tobacco material supply mechanism 56, the input mechanism 54 continually loading tobacco material into the high pressure treatment chamber 50; an output mechanism 57 for continually removing treated tobacco material 58 from the chamber; and a recovery zone 59 into which treated tobacco material is discharged from output mechanism 57 and recovered for further processing. The input and output mechanisms are each of similar configuration. An associated fluid flow system 60 acts to supply extraction solvent to the treatment chamber and acts to withdraw extract-laden solvent from that chamber. Also, a fluid flow system 62 acts to supply heated fluid to a heating jacket 66 surrounding extraction zone 49 of pressure chamber 50 for maintaining a controlled (e.g., constant) temperature within the chamber.

Within extraction zone 49 tobacco material 47 in the form of cut filler contacts pressurized extraction solvent. Jacket 66 surrounding extraction zone 49 provides for the flow of fluid to assist in maintaining the extraction zone at the desired temperature. Suitable high pressure treatment chambers and accompanying heating jackets are manufactured from conventional materials such as stainless steel. The construction and design of suitable pressure chambers and accompanying heating jackets, including selection of the proper gage steel to use for the pressure chamber, will be apparent to the skilled artisan.

The fluid flow system 60 provides for the flow of pressurized extraction solvent through the extraction zone to extract components from the tobacco material. The extraction solvent is introduced into the interior of zone 49 through a conduit 70 and is withdrawn as extract-laden solvent through a conduit 72. Conduit 72 includes a filter 74 made from fine-mesh wire screen or other suitable material near the point where conduit 72 is joined with chamber 50 to assist in preventing particles of extracted tobacco material from being withdrawn from the chamber along with extract-laden solvent. By extracted tobacco material is meant that portion of the treated tobacco material that is insoluble in the extraction solvent at the prevailing conditions of pressure and temperature. In this preferred arrangement, the flow of fluid is countercurrent to that of the tobacco material, but the flow can effectively be made co-current, if desired. Back-pressure regulator 76, pressure regulators 78 and 80, and a safety relief valve 82 act to avoid pressurizing the chamber beyond predetermined limits and to maintain a continuous source of pressurized solvent.

Fluid flow system 60 as shown in FIG. 1 further includes a source of gaseous solvent 84, a source of low boiling liquid or liquified gas 86 with a deep tube connection to assure the introduction of liquid phase into a pump 87, and a source of normally liquid co-solvent 88. Exemplary co-solvents include water, ammonia, an alcohol including methanol, ethanol and propanol, or mixtures thereof. Filters 89, 90, and 91 are respectively provided for these solvent sources, as are a high pressure compressor 92, high pressure liquid pump 87 and an associated check valve 93 for ensuring fluid flow in one direction, and a metering pump 96 also having an associated check valve 97 to ensure fluid flow in one direction. The fluids obtained from sources 84, 86, and 88 pass through a heat exchanger 98 and are filtered in a filter 100 prior to entering extraction zone 49. Surge vessel 102 provides excess available volume of extraction solvent to assist in reducing pressure fluctuations in extraction zone 49. The selection and operation of the foregoing components will be readily apparent to the skilled artisan.

System 60 also includes extract separator 104 for separating tobacco material extract from solvent and a solvent recovery system 106. Line 72 that provides flow of extract laden solvent to extract separator 104 optionally contains filter 107 to ensure that insoluble tobacco material particles passing through screen 74, if any, do not enter the extract separator. Operation and fluid flow in system 60 is more fully explained below. Those of ordinary skill in the art of tobacco material processing will recognize that the extract separator and solvent recovery system typically contain, respectively, various equipment for separating solvent from tobacco material extract, for purifying the solvent by stripping it of any remaining extract, and for repressurizing recovered solvent. Typically, separation of tobacco material extract and solvent are accomplished by cooling and/or reducing pressure. Separations of tobacco material extract from solvent at liquid conditions are typically accomplished by the use of adsorbents. Adsorbents such as molecular sieves are especially preferred, although others are available. After tobacco material extract and solvent are separated, the solvent can be stripped of any remaining tobacco material extract to purify the solvent by any of the methods known to those of ordinary skill in the art. Adsorbent separation using a charcoal adsorbent is preferred.

The fluid flow system 62 shown in FIG. 1 serves to maintain a constant temperature in the extraction zone 49, and includes a controlled (e.g., constant) temperature bath 110. Heated fluid such as water or a silicon based heat transfer fluid from bath 110 enters heating jacket 66 through a conduit 112, and exits through a conduit 113, to maintain tobacco material 47 and extraction solvent in extraction zone 49 at a controlled temperature. Means for heating the fluid and supplying the fluid to the heating jacket will be apparent to the skilled artisan.

Referring again to FIG. 1, tobacco material 47, which will typically be in the form of cut filler, is introduced and withdrawn from pressure chamber 50 at a steady rate and at conditions such as those described above, while continuously maintaining countercurrent flow of extraction solvent at the desired high pressure conditions. Typically, extraction processes for tobacco material that employ solvents at supercritical conditions are conducted at pressures of from about 450 psig to about 6,000 psig, depending on the specific solvent selected and the extractable substances to be separated from the non-extractable substances of tobacco material. Generally, pressures of from 1,100 up to about 2,000 psig are suitable for extracting substances using common solvents. Higher pressures (e.g., above 4,000 psig) can be selected for specific solvents and extractable substances, if desired.

Discreet amounts of tobacco material 47 are steadily introduced or otherwise conveyed to the pressure chamber 50 through the input mechanism 54 and subsequently withdrawn or otherwise discharged or removed from the chamber through output mechanism 57 of similar configuration. These mechanisms operate so as to substantially prevent significant fluid leakage out of the pressure chamber when the pressure chamber is pressurized above ambient pressure. To accomplish this result, the dynamic seal of the input mechanism includes two plates 120 and 122, which are shown enlarged in FIG. 3, each having flat and smooth finished surfaces that are in intimate contact. Typically, the plates are formed from advanced structural ceramic materials. The input mechanism subjects the plates to a clamping or compressive force sufficient to maintain a seal between the contacting plate surfaces such that fluid leakage between the two plates is substantially eliminated whether or not the plates are in relative sliding movement.

Plate 120 is fixed to flange 121 of pressure chamber 50 and defines apertures for the passage of tobacco material, one of which is permanently aligned with pressure chamber 50 to provide for the passage of tobacco material into pressure chamber 50. Plate 122 is fixed to a rotatable housing 123 and also defines apertures for the passage of tobacco material Typically, plates formed from advanced structural ceramic materials may have a bending moment that can result in deflection of the plate when subjected to a force. Such deflection can result in the inability of a chamber to retain a fluid under controlled conditions of pressure and significant leakage of fluid could occur. Accordingly, it is desirable that the plate be supported to substantially prevent this deflection or bending. In practice, the plates are attached to the surfaces of metal supports. The metal surface to which a component made from advanced structural ceramic materials is bound is matted to have a rough surface finish for attachment. In practice, it has been found that an Armstrong® epoxy adhesive set with a low temperature (Type A-2) activator or hardener compound and cured at approximately 130° F. for about two hours provides a secure attachment. Other epoxies, brazing techniques, and other techniques known to those skilled in the art can also be used to bond a plate made from advanced structural ceramic materials to a metal support. The metal surface can be coated with a film of desired thickness of advanced structural ceramic material. Various coating methods can be applied for this purpose including high temperature plasma coating and others.

Plate 122 is slidable against plate 120, with or without added lubrication, by rotating housing 123. By rotating the housing, plates 120 and 122 define, at selected positions, aligned apertures for the passage of tobacco material from the supply 56 into pressure chamber 50 without a significant fluid leakage.

The clamping or compressive force applied to plates 120 and 122, sealing pressure chamber 50 and holding housing 123 in pressure tight communication with high pressure treatment chamber 50, is supplied by hydraulic ram 124 or other suitable force exerting means. The dynamic seal provided thereby is sufficient to minimize significant leakage during conditions of normal use of the apparatus. For purposes of the present invention, a dynamic seal is the closure or union between the two intimately contacting surfaces of sufficient sealing area of plates 120 and 122, one of which, plate 122, is movable. For purposes of the present invention, leakage is the undesirable and gradual escape of fluid from the apparatus, or entry of air into the apparatus. This dynamic seal substantially reduces or prevents the travel of fluid across the closure. The force exerted by hydraulic ram 124 to create such a seal provides at least a required clamping force on plates 120 and 122. Required clamping force can be defined as that minimum compressive force necessary to substantially eliminate a fluid leakage between the contacting surfaces of the plates. At any given pressure a required clamping force is therefore applied over a minimum seal width or area of contact of the seal surfaces to substantially prevent a fluid leakage, even during relative movement. To ensure that plates made of advanced structural ceramic materials are not displaced from their fixed positions on the apparatus during unit operation, metal-retaining rings surrounding each of the plates 120 and 122 are often desirable.

A conventional driving mechanism 125 for rotating housing 123 includes annular gear 126, which surrounds the housing and has teeth cut on its outer surface, that engages driven pinion 127. Motor 128 drives pinion 127 to rotate housing 123 and thereby rotates plate 122 to align the apertures in plates 120 and 122. Driving mechanism 125 rotates housing 123 and attached plate 122 about a center post 132.

The driving mechanism 125 rotates the housing 123 to align apertures in plates 120 and 122 to provide passages through which input mechanism 54 receives tobacco material 47 from a supply mechanism 56 and discharges that material into treatment chamber 50. Input mechanism 54 receives tobacco material 47 through aligned apertures in plates 120 and 122 at a location remote from high pressure chamber 50. Supply mechanism 56 includes tobacco material supply 134 that supplies tobacco material 47 at ambient pressure to input mechanism 54 through metering star valve 136 and associated conduit 138. Skirted piston 139 in conduit 138 displaces the metered amount of tobacco material through the aligned apertures in plates 120 and 122.

Housing 123 of input mechanism 54 contains cells or containers 150 for containing tobacco material 47 received through the aligned apertures in plates 120 and 122. As shown enlarged in FIG. 3, each of the cells contains a piston 152. Cells 150 can include a wear-resistant liner made from advanced structural ceramic materials, if desired. Preferably, piston 152 is formed of porous advanced structural ceramic materials or supported fine-mesh screen to allow pressure to equilibrate on each side of the piston head surface while preventing tobacco material from passing through or around the piston. In this way, when a cell loaded with tobacco material is rotated to communicate with pressure chamber 50, the piston 152 can displace tobacco material from the cell into the chamber without working against the pressurized fluid.

Referring again to FIG. 1, tobacco material within pressure chamber 50 enters extraction zone 49 and contacts the extraction solvent under controlled conditions of pressure and temperature. Tobacco material remains in contact with solvent in the extraction zone for a sufficient period of time to enable a desired extraction to take place. Extractladen solvent is continuously removed from extraction zone 49 through conduit 72 and is sent to extract separator 104 for recovery of tobacco material extract. Tobacco material that is insoluble in the solvent at the process conditions of temperature and pressure passes or is otherwise advanced to the output end of chamber 50. At the output end of chamber 50, tobacco material is continually removed from the high pressure chamber by means of output mechanism 57.

As seen in FIG. 1, output mechanism 57 operates analogously to input mechanism 54 to remove tobacco material from the treatment chamber and to discharge the tobacco material to a recovery zone 59 at ambient pressure. Output mechanism 57 contains parts similar to those of input mechanism 54, and these are indicated by the use of primes. For example, housing 123' of output mechanism 57 is similar to housing 123 of input mechanism 54. As shown in FIG. 1, tobacco material passes from pressure chamber 50 through aligned apertures in plates 120' and 122' into a cell 150' that is contained in housing 123' of output mechanism 57 at position P'. When housing 123' is rotated to align the cell with an aperture in plate 120' remote from chamber 50, then piston 152' extends to discharge extracted tobacco material 58 into a separator 153 of recovery zone 59, which is near ambient pressure. Extracted tobacco material separates from remaining extraction solvent and is recovered. The separated, remaining extraction solvent passes through conduit 154 to solvent recovery system 106 to be used again.

Figure 2:
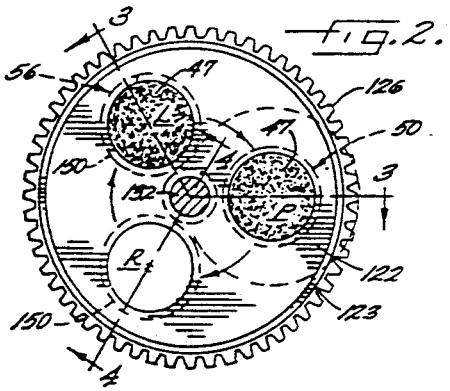
FIG. 2 illustrates an enlarged transverse section of the apparatus taken substantially along line 2—2 of FIG. 1.
Figure 4:
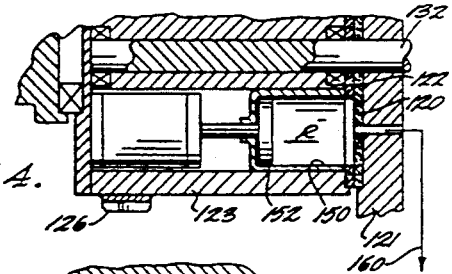
FIG. 4 illustrates in a partial longitudinal section an enlarged fragmentary portion of the input mechanism of FIG. 1 taken substantially along line 4—4 of FIG. 2.
Figure 3:
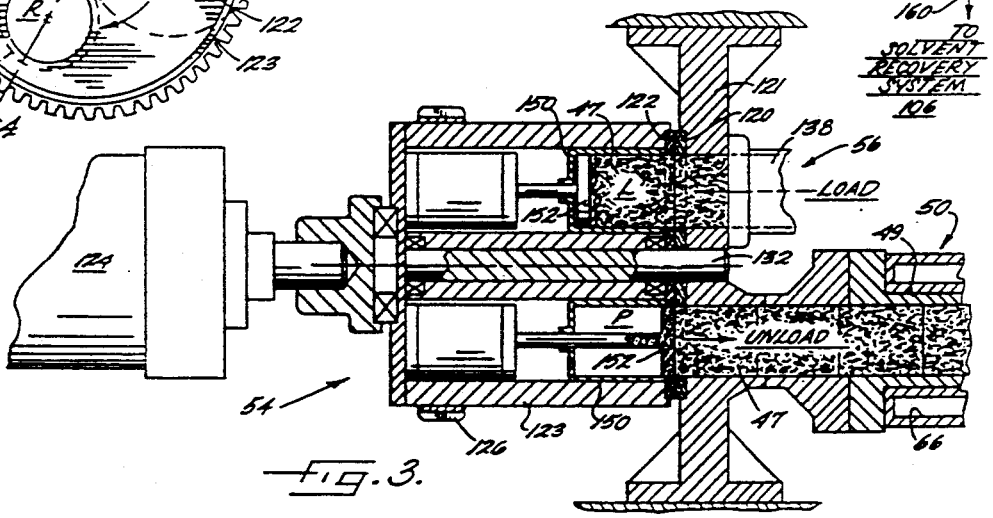
FIG. 3 illustrates in partial longitudinal section an enlarged portion of the apparatus entrance mechanism of FIG. 1 taken substantially along line 3—3 of FIG. 2.

Turning now to FIGS. 2, 3, and 4, which illustrate additional details of the apparatus of FIG. 1, plate 122, which is fixed to housing 123 of input mechanism 54, has three apertures, which are shown in FIG. 2, for the passage of tobacco material. The housing 123 contains three corresponding cells 150 and associated pistons 152, two of which are shown in FIG. 3 and one of which is shown in FIG. 4, for containing tobacco material. In FIGS. 1 and 3, the longitudinal section taken through the input mechanism 54 illustrates cells 150 and pistons 152 at positions L and P. FIG. 4 illustrates a fragmentary longitudinal section taken along a transverse radius at an angle of 120° to the section of FIG. 3, in which a cell 150 and piston 152 are at position R. By rotating housing 123 of entrance means 54, these three cells successively occupy the various basic index positions L, P, and R: L for loading the cell with tobacco material 47 from the supply 56 shown in FIG. 1, P for placing tobacco material 47 in the pressurized chamber 50 shown in FIG. 3, and R for recovery of pressurized extraction solvent that remains in the cell after a load of tobacco material has been placed in the chamber, which is shown in FIG. 4. Stationary plate 120, which is fixed to flange 121 located at the input end of pressure chamber 50, defines two apertures each for the passage of tobacco material, one at entrance position L and one at pressurization position P, as illustrated in FIGS. 1 and 3. A third aperture at recovery position R shown in FIG. 4 is of a smaller diameter of between about 1/16-in. and about 1-in. and provides for recovery of pressurized extraction solvent. Such a recovery step is preferably practiced because a cell at position P is in pressure tight communication with chamber 50 and becomes filled with extraction solvent. However, while pistons 152 load the tobacco material into chamber 50 as shown in FIG. 3, they do not displace the pressurized extraction solvent, which is allowed to remain in the cell.

Pressurized solvent that remains in the cell after tobacco material is loaded into chamber 50 is recovered through a conduit 160 as shown in FIG. 4. The skilled artisan will recognize that pressurized solvent remaining in the cell can also be recovered through a conduit communicating with the cell through a side wall thereof. As shown in FIG. 1, filter 161 is provided in conduit 160 to prevent remaining tobacco material 47 from entering the fluid flow system 60. Check valve 162 is provided on line 160 to ensure fluid flow in one direction. The recovered solvent can be sent either to the solvent recovery system 106 or the extract separator 104 depending on the concentration of extracted tobacco material contained therein. Flow of solvent from a cell at position R to the solvent recovery system 106 is illustrated in FIG. 1.

Figure 21:
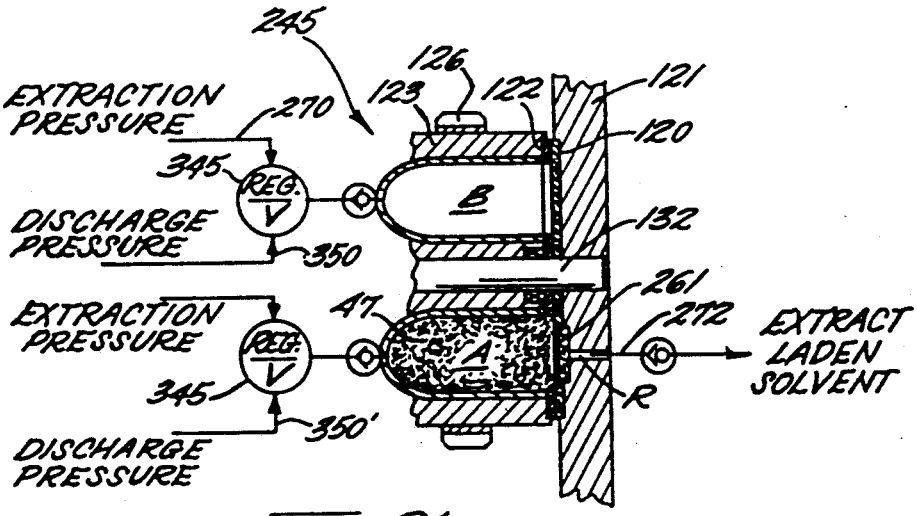
FIG. 21 illustrates in a longitudinal section a view of the embodiment illustrated in FIGS. 15 through 20 taken along line 21—21 of FIG. 19.

Output mechanism 57, as shown in FIG. 1, contains features analogous to input mechanism 54 such as are discussed above and are illustrated in FIGS. 2, 3, and 4. Regarding output mechanism 57, a cell 150' at position P' receives tobacco material under conditions of pressure from chamber 50. Housing 123' rotates that cell containing tobacco material under conditions of pressure to position R'. Simultaneously, an empty cell formerly at position L' is rotated to position P'. At R' the pressure in the cell is reduced in a controlled fashion in a manner similar to that described with respect to FIG. 4. As the skilled artisan will recognize, a screen or other suitable means similar to that illustrated in FIG. 21 is used to keep extracted tobacco material in the cell until depressurization is completed. Extraction fluid that leaves the cell passes to the solvent recovery system through conduit 154. After the pressure within the cell has been reduced to a suitable level, driving mechanism 125' rotates the housing 123' to cause the cell at position R' to occupy position L' where extracted tobacco material 58 is discharged to low pressure separator 153. By continually and synchronously rotating the housings 123 and 123' at the input 54 and output 57, respectively, tobacco material is processed while continually moving through the chamber.

Turning now to a consideration of the process dynamics, flow of tobacco material through the system begins with loading system 56, as shown in FIG. 1. Loading system 56 provides tobacco material 47 to a star valve 136 that meters a measured amount of tobacco material to loading conduit 138. The tobacco material has typically had its moisture content adjusted to promote pliability and/or extraction of selected components. A reciprocating skirted piston 139 in conduit 138 displaces the metered tobacco material through apertures in ceramic plates 120 and 122 into a tobacco material loading cell 150 at index position L. As shown in FIG. 3, piston 152 within cell 150 at position L is fully depressed to allow the cell to fill with tobacco material 47. After filling, the driving mechanism turns housing 123 to rotate the housing with attached plate 122 to align a tobacco material filled cell, shown in FIG. 3 in communication with the pressure chamber at index position P, with the aperture in ceramic plate 120. The aperture in ceramic plate 120 communicates with chamber 50. Simultaneously, another cell in the driving mechanism aligns with the tobacco material supply system 56 at index position L. Piston 152 then extends to load tobacco material into the pressure chamber 50 as shown in FIG. 3. Other methods and components for introducing tobacco material into the chamber will be apparent to the skilled artisan.

Referring also to FIG. 1, a cell 150 at position P is shown aligned with an aperture in ceramic plate 120 at the entrance to chamber 50. The cell is in pressure-tight communication and material communicable relation with the chamber, and the pressure in the chamber remains substantially stable. By pressure communication is meant the unrestricted flow of fluid (i.e., extraction solvent) from the chamber into the cell such that the cell and chamber are in pressure equilibrium. By material communicable relation is meant the ability to transfer a material (i.e., tobacco material) from a cell to the treatment chamber. Any pressure variation is acceptably low because the volume of the cell is small compared to that of the chamber, a surge vessel 102 sized for the volume of the chamber reduces any fluctuations of pressure that might occur, extraction solvent is continuously supplied to the chamber to maintain the pressure through fluid system 60, and the dynamic seal prevents significant fluid leakage. A piston is illustrated in FIG. 1 at index position P ready to discharge tobacco material 47 from input mechanism 54 into high pressure chamber 50. Other methods and components for discharging tobacco material into the chamber will be apparent to the skilled artisan.

Once the piston discharges tobacco material from a cell at position P into the chamber, housing 123 rotates to index the cell to position R. A cell occupying position R at the input mechanism 54 is illustrated in FIG. 4. The pressure remaining in a cell indexed to position R from position P is reduced and the discharged extraction solvent is sent to recovery system 106 through conduit 160. The cell is then indexed to position L for loading of tobacco material.

As the cells are filled with tobacco material, and the pistons discharge these discreet portions of tobacco material to the chamber, the tobacco material advances through the extraction zone in intimate contact with countercurrently flowing extraction solvent under pressure. At the output mechanism 57, advancing discreet portions of tobacco material fill a cell in housing 123' shown at output position P' in pressure communication and material communicable relation with chamber 50. When filled, this cell is indexed to recovery position R' to reduce the pressure in the cell prior to releasing the tobacco material therefrom. Unlike cells in the input mechanism, a cell in the output mechanism at position R' contains tobacco material, the tobacco material having just been loaded into a cell 150' at previous index position P'. As such, a certain amount of the tobacco material is subjected to treatment while a certain amount of the tobacco material i) simultaneously is removed from the chamber, and/or ii) simultaneously is introduced into the chamber.

After pressure in a cell 150' at R' is reduced to the desired level, housing 123' is turned to index the cell to position L'. Extracted tobacco material 58 is shown in FIG. 1 being discharged from a cell at position L' into low-pressure separator 153, which may include an ordinary separator such as a cyclone, where the extracted tobacco material is separated from remaining solvent. The separated remaining solvent, which includes that released from a cell 150' at position R', in the form of an expanded gas, is discharged through the top of the expansion zone through low pressure conduit 154 where it can be recovered, repressurized through known means such as high pressure compression or high pressure liquid pumping, which are part of solvent recovery system 106, and returned to the extraction chamber. While extraction solvent is continually discharged through conduits 72, 154 and 160, solvent is continually supplied through conduit 70 to extraction chamber 50. Extracted tobacco material 163 is discharged through the bottom of separator 154, where it will be recovered for further treatment, including reordering, if necessary. Conveyor 163 for transporting extracted tobacco material 47 is illustrated.

Depressurization at R' can be carried out in a stepwise fashion employing a means analogous to that illustrated for position R. If desired, the extracted tobacco material can be expanded during a single depressurization step where an expansion agent, for example, propane, is used as the extractant. In this event, the pressure is rapidly reduced to or near atmospheric pressure from a predetermined higher pressure within a time period of less than 10 minutes, preferably about 1 to 300 seconds, optimally less than 10 seconds. It may still be necessary to conduct initial depressurization stepwise to avoid degrading (e.g., shattering, exploding, creating fines, reducing size) of the tobacco material as a result of a large pressure drop. Additionally, a post-expansion heating step may be necessary to fix the tobacco material in expanded condition.

It should be noted that a multitude of configurations of the apparatus of this invention are envisioned that are capable of continually extracting a flow of tobacco material and of maintaining substantially stable conditions of pressure in an extraction zone. For example, the input and output means need not be round. A kidney-shaped plate and housing cross-section is useful. Rectangular plates that linearly reciprocate are effective. Plates moving in a rotational path can accomplish input and output of tobacco material with or without reciprocal movement. Advantageously, the input mechanism 54 and output mechanism 57 will reciprocally rotate to simplify operation of the apparatus. Essentially any mechanism providing for sealing contact between planar and non-planar regular surfaces in intimate contact and sliding movement therebetween in connection with separate removal of extract-laden solvent is useful for extracting tobacco material, continuously maintaining extraction agent pressures, and for transporting tobacco material across a pressure boundary. Typically, extraction agent pressures are from about 450 to about 6,000 psig for supercritical gas conditions and from about 20 to about 1,000 psig for liquid conditions.

Figure 5:
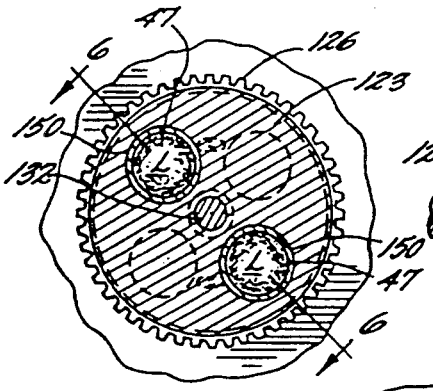
FIG. 5 illustrates in transverse section a portion of an input mechanism for providing material simultaneously to two treatment chambers, taken along a section analogous to that of line 2—2 in FIG. 1.
Figure 6:
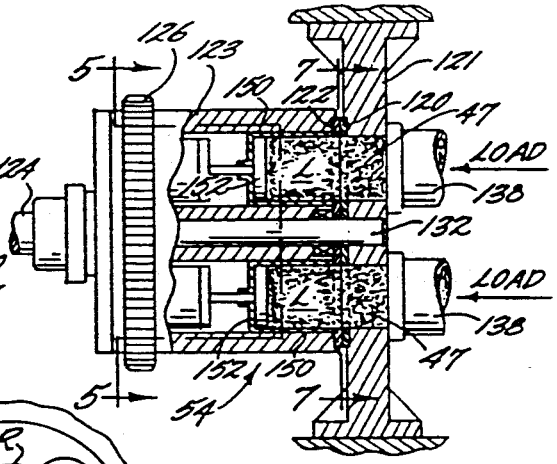
FIG. 6 illustrates in a partial longitudinal section a side portion of the input mechanism of FIG. 5 taken substantially along line 6—6.
Figure 7:
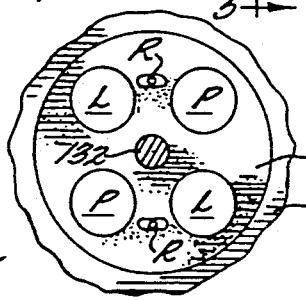
FIG. 7 illustrates a transverse section of the apparatus taken along line 7—7 of FIG. 6.
Figure 8:
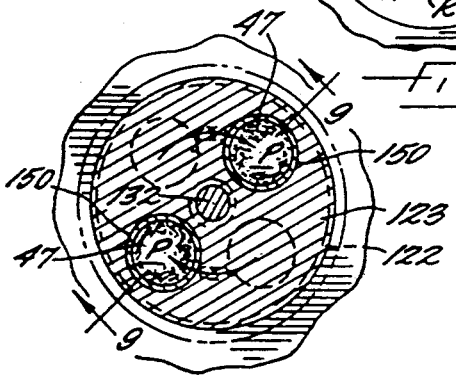
FIGS. 8 and 10 illustrate the transverse section of FIG. 5 rotated through various positions that, together with FIG. 5, illustrate loading of material, discharge to a pressurized zone, and recovery of pressurized fluid.
Figure 9:
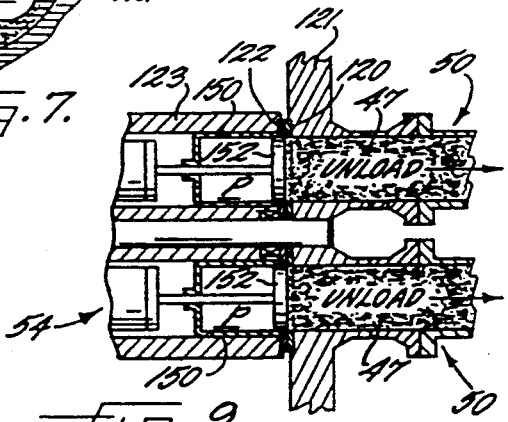
FIGS. 9 and 11 illustrate in longitudinal sections side views of the apparatus depicted in FIGS. 8 and 10, respectively.
Figure 10:
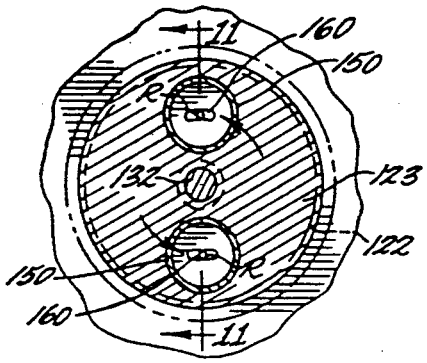

Turning now to FIGS. 5 through 11, these figures illustrate the input portion of an apparatus 164 similar to that shown in FIGS. 1 through 4. Apparatus 164 includes input mechanism 54, as shown in FIG. 6, that simultaneously supplies two high pressure treatment chambers 50, which are shown in FIG. 9. Likewise, an output mechanism discharges tobacco material from the two chambers simultaneously. For supplying two chambers simultaneously, ceramic plate 120, as shown in FIG. 7, defines four apertures for the passage of tobacco material, one L and one P associated with each chamber. Ceramic plate 122, as illustrated in FIGS. 5, 6, and 8 through 11, defines two apertures, one for each chamber, that reciprocate between index positions L and P for the chamber served. Recovery ports R, as shown in FIGS. 7 and 10, positioned between the L and P positions for a single chamber provide for removal of solvent from the cell after the tobacco material has been placed in the chamber.

Figure 11:
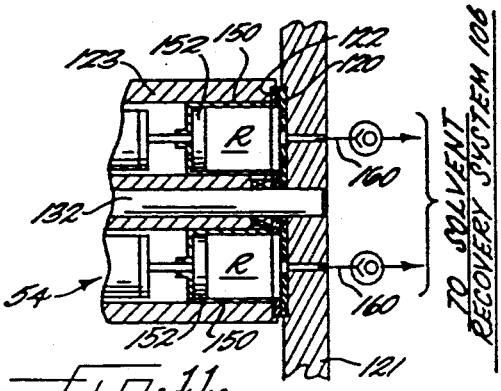

The apparatus operates in a manner analogous to that previously described with reference to FIGS. 1 through 4. Tobacco material 47 is simultaneously loaded into two cells of the input mechanism 54 that are at index positions L as shown in FIGS. 5 and 6. The housing 123 is indexed to positions P as shown in FIGS. 8 and 9 where tobacco material is discharged into the chambers 50. The housing reciprocates and reaches index positions R for recovery of extraction solvent from the cells prior to returning to positions L, as shown in FIGS. 10 and 11. Tobacco material can be withdrawn simultaneously from the two treatment chambers 50 in an analogous manner through an output mechanism that is similar to the input mechanism, as previously discussed in reference to FIG. 1.

Figure 12:
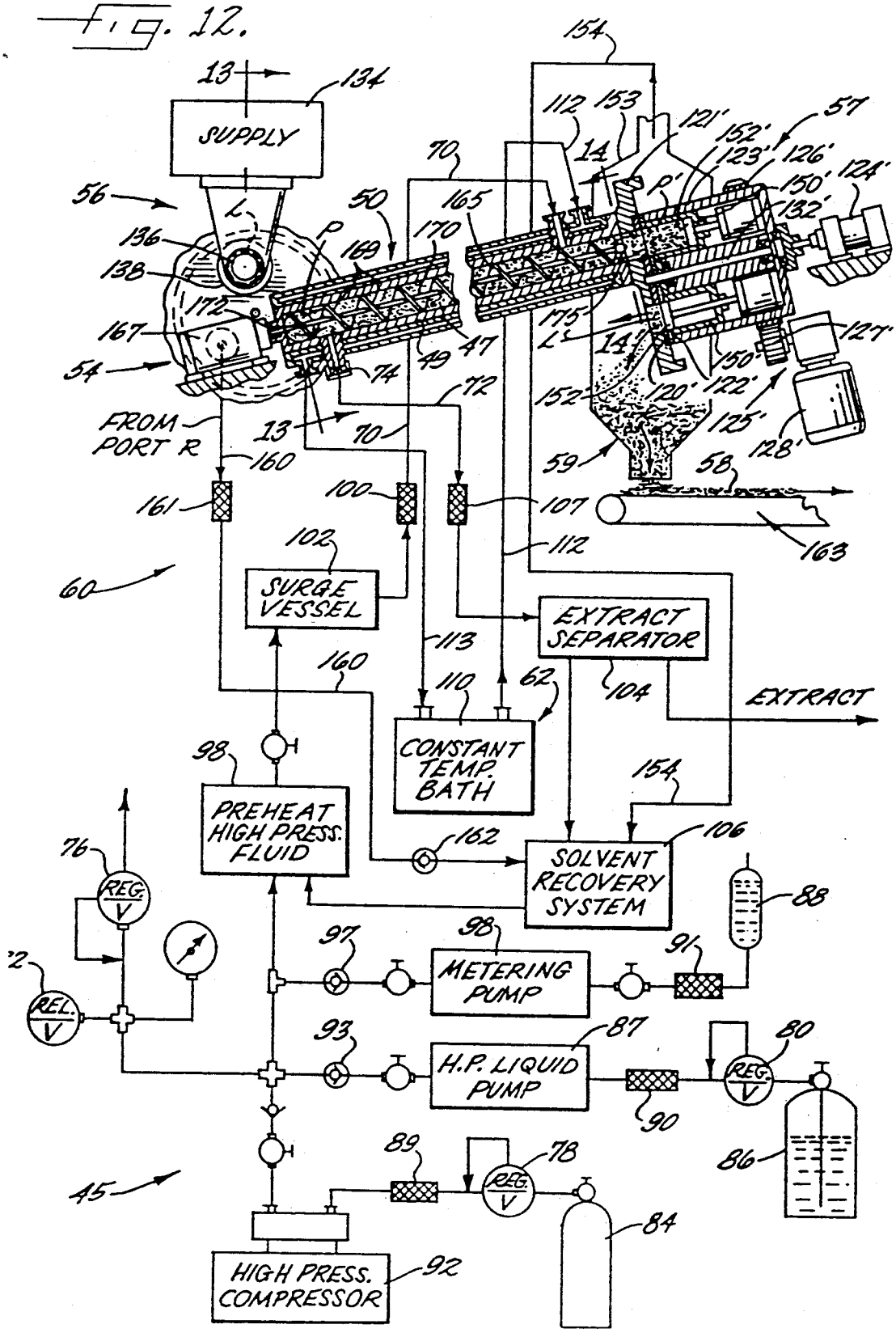
FIG. 12 illustrates in a partial longitudinal section a side view of a preferred apparatus of the present invention for treating a continual flow of a material, including flow diagrams for pressurized fluid and auxiliary equipment.
Figure 13:
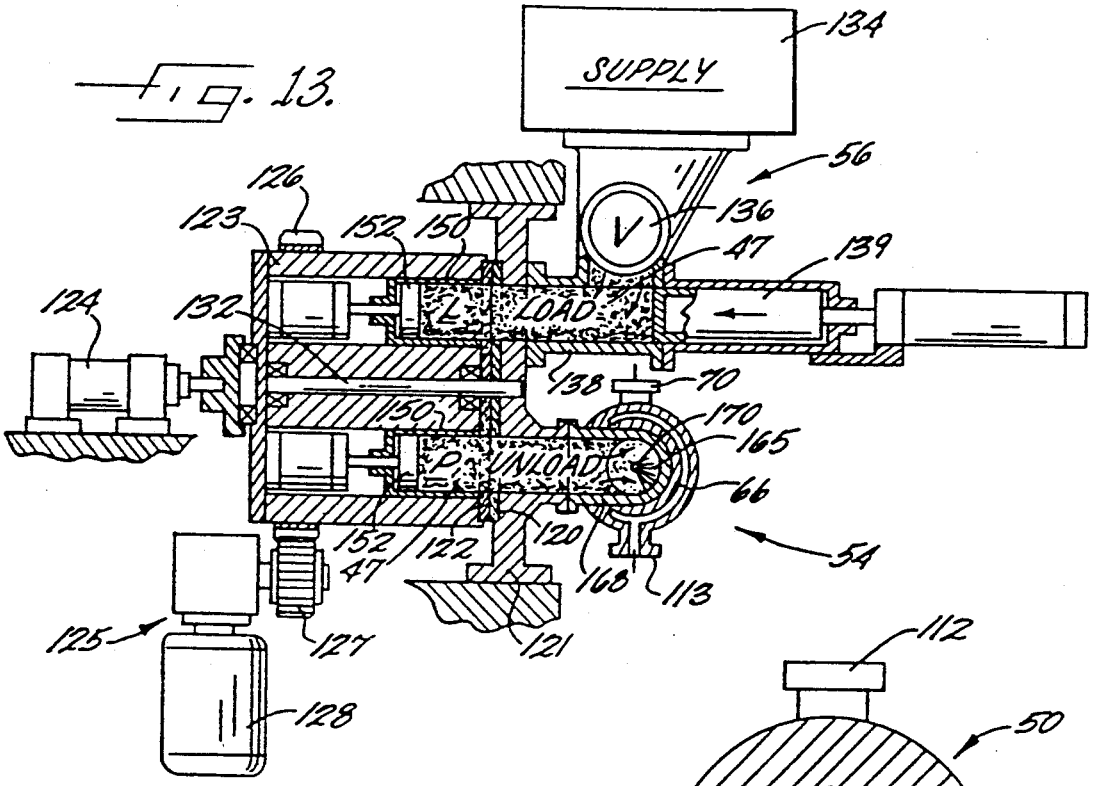
FIG. 13 illustrates in a partial longitudinal section a side view of the input mechanism of the embodiment illustrated in FIG. 12, which is out of the plane of FIG. 12, and which is taken along line 13—13 of FIG. 12.
Figure 14:
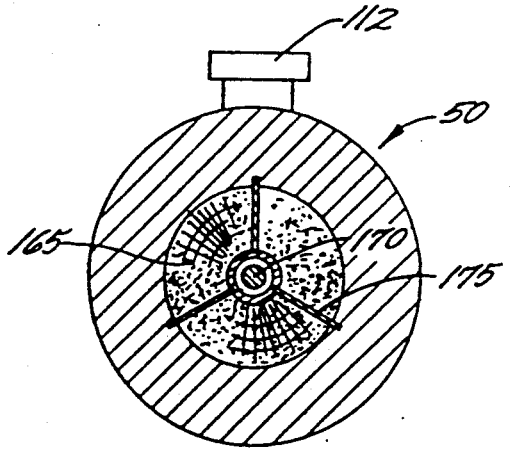
FIG. 14 illustrates a transverse section taken along line 14—14 of FIG. 12.

Turning now to FIGS. 12 through 14, these figures illustrate a preferred apparatus 45 for treating a flow of tobacco material moving continually through a high pressure treatment chamber. This apparatus is similar to that described above with reference to FIG. 1, and has been modified to provide a screw conveyor 165 to assist in transporting the tobacco material through the high pressure treatment chamber. A motor 167 drives the screw conveyor, preferably continously at a rate coordinated with the rate of continual flow of tobacco material into and out of chamber 50. Feed and exit rates can be varied depending upon the rate of the screw, residence or dwell time, process conditions, and size of the cells. The selection of the configuration of the screw conveyor and of the materials of which it is made will be apparent to the skilled artisan depending upon the particular process to be conducted.

For the apparatus illustrated in FIG. 12, the input 54 is advantageously placed for providing tobacco material to a chamber 50 that has been equipped with a screw conveyor 165. The input mechanism 54 communicates with the entrances to the pressure chamber through a lateral portion 168 thereof, as shown in FIG. 13. Sharp bends in the process lines are typically avoided because tobacco material used in the process of this invention typically has a high moisture content. However, the above described arrangement enables a screw conveyor to transport tobacco material in a direction perpendicular to its entry into chamber 50. Entrance 54, except for its orientation to the chamber 50, is similar in its function and internal parts to that illustrated in FIGS. 1 through 4.

Screw conveyor 165 has a series of flights 169 surrounding a shaft 170 that is turned by the motor 167. Shaft 170 is journalled for rotation in a conventional high pressure mechanical seal 172, which is shown in FIG. 12, that substantially prevents leakage of extraction solvent. The flights 169 pick up tobacco material entering chamber 50 and by their rotation compel the tobacco material to move through the chamber to the output end thereof. Near output mechanism 57, the flights move the tobacco material over tripartite knife blade support 175, which is shown enlarged in FIG. 14, into a cell 150' at position P' having a retracted piston 152'. Driving mechanism 125' then rotates housing 123' to index the cell to a position for pressure reduction, as previously described with reference to position R' of FIG. 1. Extracted tobacco material 58 is shown being discharged.

Figure 15:
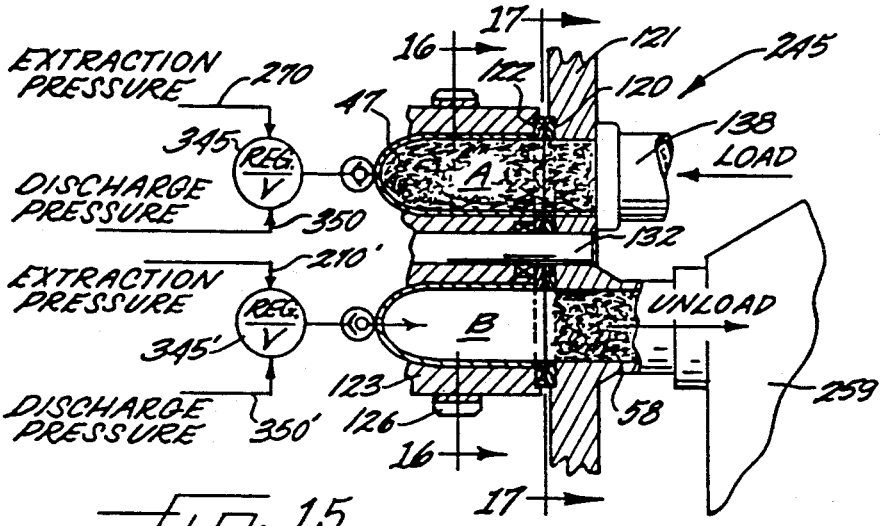
FIG. 15 illustrates in partial longitudinal section a side view of a representative batch apparatus of the present invention for treating material in a batch mode.

Turning now to a consideration of FIGS. 15 through 21, these drawings illustrate a representative apparatus of the present invention for treating a material in a batch mode. More particularly, FIG. 15 illustrates a portion of a reciprocally rotating batch apparatus 245 for the extraction of substances from tobacco material 47. Apparatus 245 contains two high pressure treatment chambers or cells A and B that alternately reciprocate between positions for loading tobacco material into a treatment cell and subsequently unloading extracted tobacco material from the cell. FIG. 15 shows cell A at the load position receiving tobacco material 47 through a conduit 138. FIG. 15 shows cell B at the unload position where extracted tobacco material 58 is discharged to recovery zone 259.

Conduits 270 and 270' shown in FIG. 15 alternately supply a fluid extraction solvent to cells A and B, respectively, at controlled extraction conditions of pressure and temperature for the extraction of substances from tobacco material contained in the cells. The tobacco material contained in these cells remains in contact with extraction solvent under pressure for a time sufficient for tobacco material substances that are soluble in the extraction solvent under the process conditions to enter the fluid phase. Thereafter, extract laden solvent is alternately withdrawn from cells A and B through conduits 272 and 272', respectively, as shown in FIG. 21 for cell A. FIGS. 16 through 20 illustrate the positions of conduits 272 and 272' on the apparatus.

Figure 16:
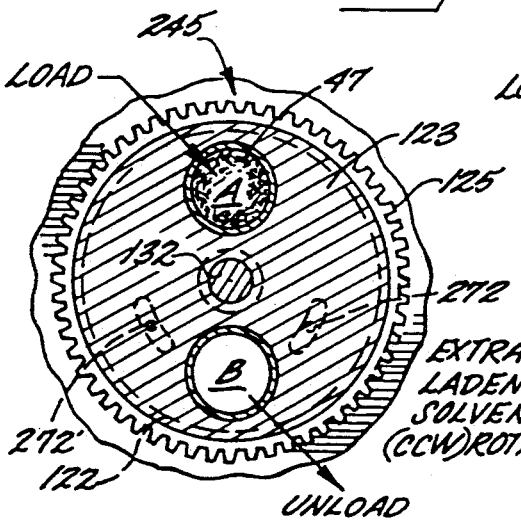
FIG. 16 illustrates a transverse section taken substantially along line 16—16 of FIG. 15.
Figure 17:
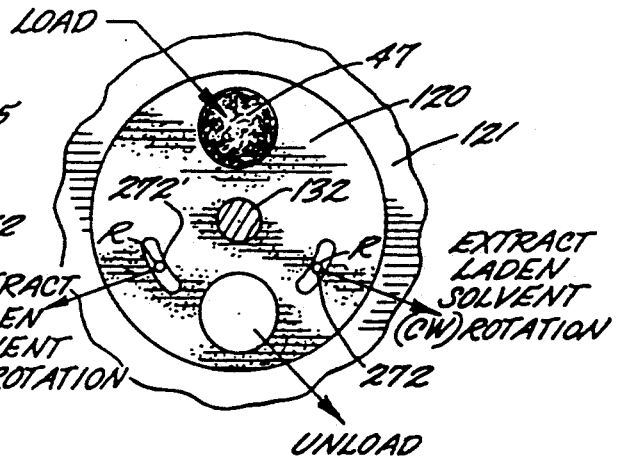
FIG. 17 illustrates a transverse section taken substantially along line 17—17 of FIG. 15.

Cells A and B are sealed with a dynamic seal similar to that described with reference to FIGS. 1 through 14. As illustrated in FIG. 15, the dynamic seal includes two plates 120 and 122, which are preferably manufactured from advanced structural ceramic materials. Each plate defines two apertures for the passage of tobacco material, as shown in FIGS. 16 and 17. Plate 120 is stationary and defines one aperture at the load positoin and one at the unload position. Plate 122 is rotatively movable and defines one aperture that is permanently aligned with cell A and one that is permanently aligned with cell B. As shown in FIGS. 16 through 20, plate 122 also contains two smaller kidney-shaped apertures, one of which communicates with conduit 272 and one of which communicates with conduit 272' to provide for removal of extract laden solvent from, respectively, cells A and B.

Plate 122 is fixed to a reciprocally rotatable housing 123 that contains cells A and B, as shown in FIG. 15. Housing 123 is rotated by means of an annular gear 126 about a center post 132 in a manner similar to that described with reference to FIG. 1 for housing 123. Plate 120 is fixed to a stationary flange 121 similar to flange 121 described with reference to FIG. 1. Flange 121 provides communication for loading tobacco material into and unloading tobacco material from the cells.

Extracted tobacco material, which is that portion of the treated tobacco material that is insoluble in the extraction solvent, is discharged from cells A and B through aligned apertures in plates 120 and 122 by using a "blowout" technique with a fluid (i.e., air or nitrogen) at relatively low pressure that is supplied to the cells through conduits 350 and 350', respectively, when a cell is at the unload position. FIG. 15 illustrates a fluid at discharge pressure being supplied through conduit 350' to cell B to remove extracted tobacco material therefrom.

Figure 18:
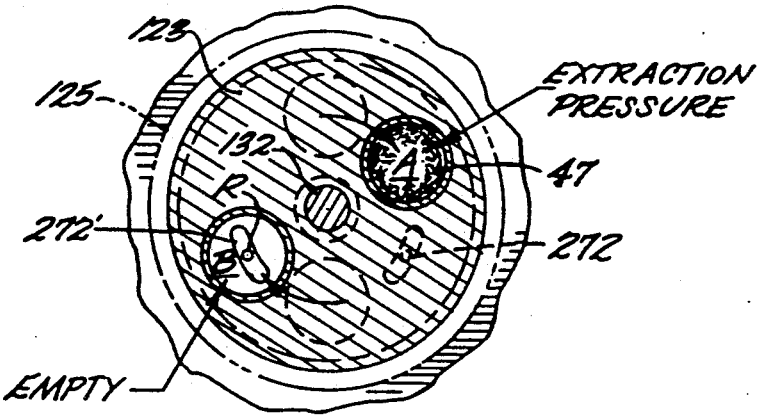
FIGS. 18, 19, and 20 illustrate the transverse section of FIG. 16 rotated through various positions that illustrate together with FIG. 16 loading of material, contacting the material with a pressurized treatment fluid, recovery of the pressurized fluid, and unloading of treated material.
Figure 19:
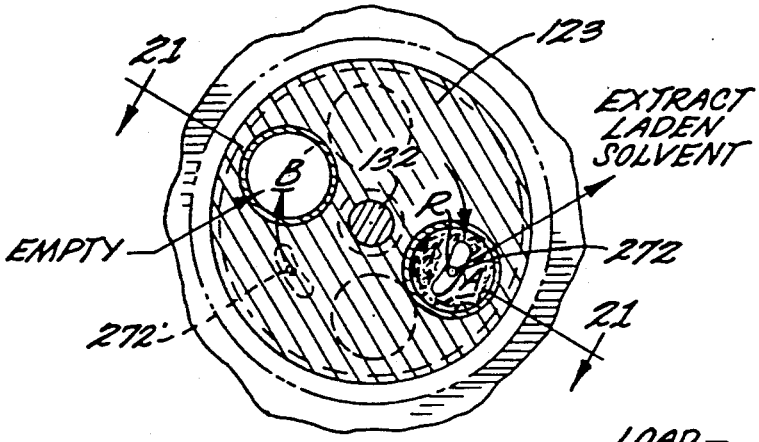

Considering the steps of batchwise extraction of tobacco material using apparatus 245, tobacco material 47 enters cell A at the load position through aligned apertures in plates 120 and 122, which is shown in FIG. 15. The housing 123 is rotated to the position illustrated in FIG. 18 in which the apertures in the plates are no longer aligned and the cells are sealed. High pressure conduit 270, shown in FIG. 1, supplies extraction solvent to cell A when cell A, filled with tobacco material, has been rotated to a sealed position as shown in FIG. 18. Tobacco material remains in contact with extraction solvent for a time sufficient to enable extractable substances to enter the fluid phase. After further rotation in the same direction, cell A, filled with tobacco material in contact with extraction solvent, reaches solvent recovery line 272, shown in FIG. 19. Extract-laden solvent is withdrawn from cell A through line 272, as shown in FIG. 21, that communicates with stationary plate 120. Filter 261 shown in FIG. 21 is provided to prevent tobacco material particles that are insoluble in the solvent from entering line 272 for recovery of extract-laden solvent. The housing continues to rotate in the same direction to reach the unload position illustrated in FIG. 20 where extracted tobacco material is unloaded. Discharge pressure line 350, as shown in FIG. 15, provides a source of low pressure gas to cell A through 3-way regulating valve 345 to aid discharging the tobacco material when cell A has reached the unload position.

Figure 20:
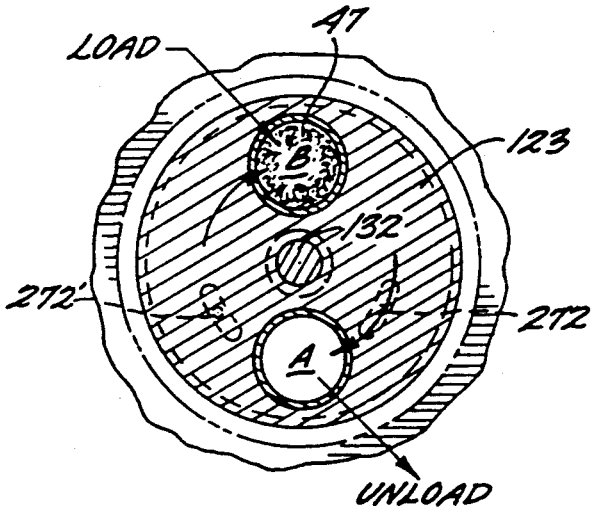

As extracted tobacco material 58 is discharged from cell A, cell B is loaded with tobacco material at the load position as shown in FIG. 20. By means of reciprocating rotation of the housing, cells A and B are alternately loaded, pressurized, depressurized, and unloaded in analogous manners.

Figure 22:
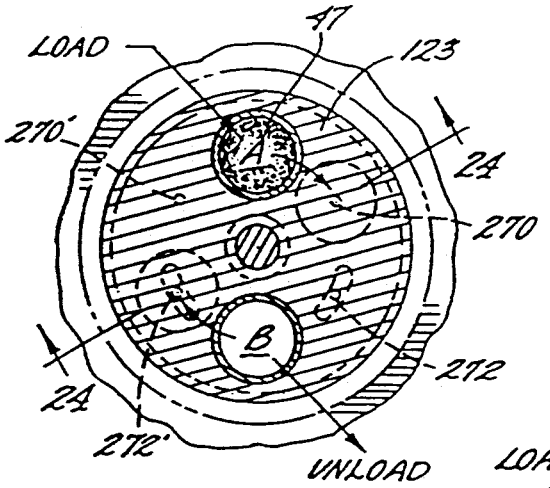
FIG. 22 illustrates in a transverse section analogous to that of FIG. 16 another apparatus for treating a material in a batch mode.
Figure 23:
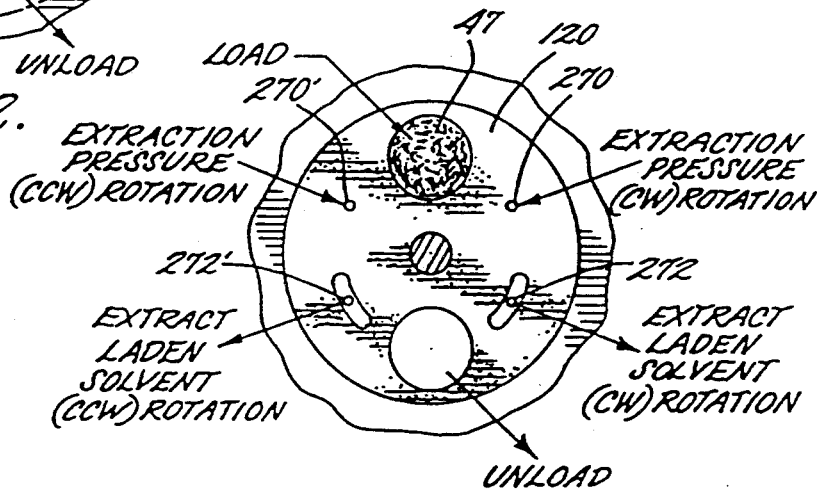
FIG. 23 illustrates another transverse section of the apparatus of FIG. 22, analogous to that of FIG. 17.
Figure 24:
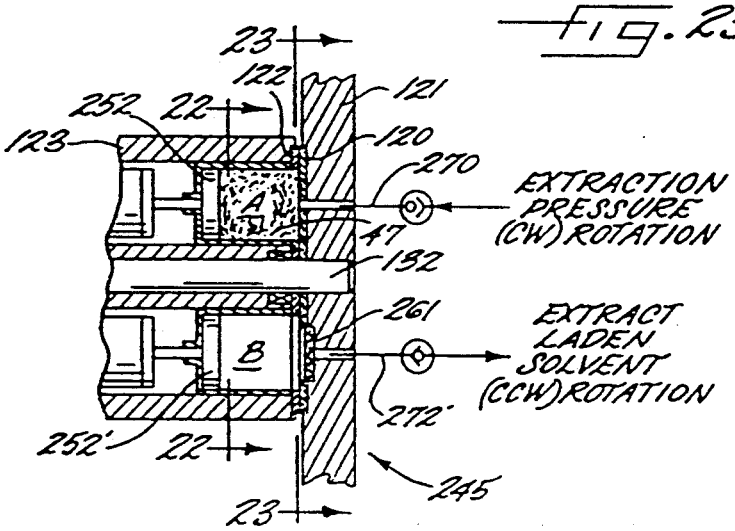
FIG. 24 illustrates in a longitudinal section a portion of the apparatus of FIGS. 22 and 23.

A portion of another representative apparatus 245 analogous to that of FIGS. 15 through 21 is illustrated in FIGS. 22 through 24. Apparatus 245, as shown in FIG. 24, provides for extraction solvent entering cell A, which has been loaded with tobacco material, through conduit 270 through a small aperture in the stationary plate 120. Extract-laden solvent is removed as previously described with reference to FIG. 21. Extracted tobacco material is discharged from cell A at the unload position using a piston 252 while cell B is loaded. Pistons 252 and 252' are illustrated in FIG. 24. Otherwise, a batchwise extraction operation is conducted as described with reference to FIGS. 15 through 21.

Figure 25:
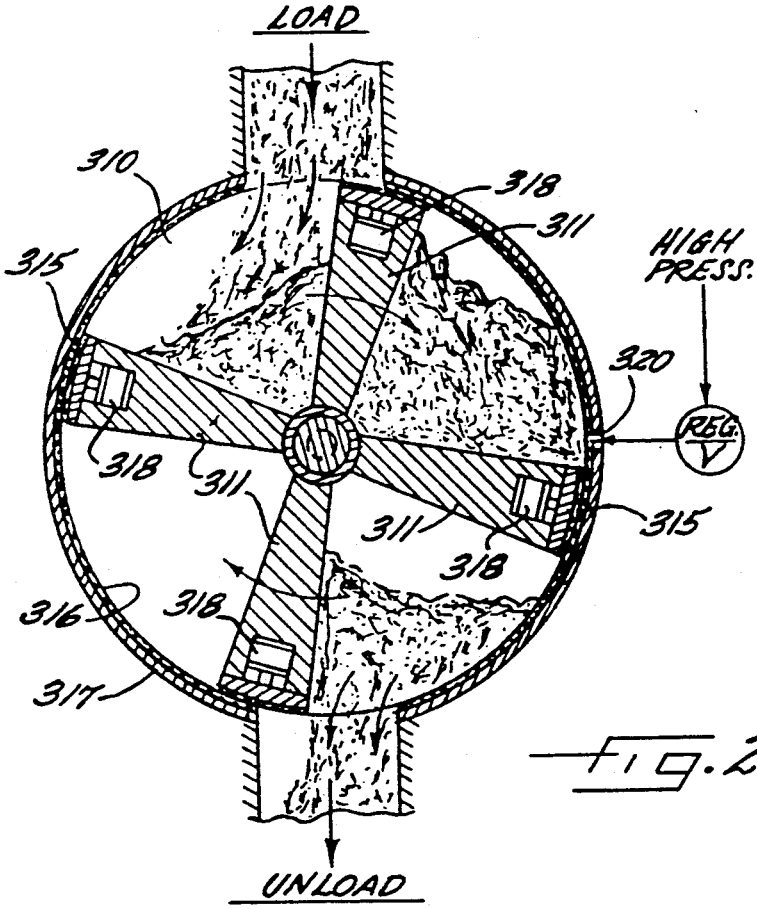
FIG. 25 illustrates in cross section a side view of another representative apparatus of the present invention for treating a continual flow of a material.

FIG. 25 illustrates yet another, though not preferred, embodiment for providing a flow of tobacco material that is subjected to high pressure contact (e.g. impregnation) with a fluid in the chambers of a rotary lock apparatus. Tobacco material is loaded into chambers 310 of the lock defined by vanes 311 that are capable of withstanding high pressure. The vanes have end portions 315 defining curved advanced ceramic material surfaces that sealingly and slidably contact interior wall 316 of the rotary lock housing, also formed of advanced structural ceramic material. The advanced structural ceramic material surfaces on the ends of the vanes are biased against the inner wall of the rotary lock to prevent substantial fluid leakage by biasing means 318, which may be a conventional hydraulic or spring mechanism. During use, the vanes 311 are rotated about the central axis of the lock so as to sealingly and slidably contact the interior wall 316 of the rotary lock. High pressure fluid enters the lock through a conduit at 320 after a leading vane of a chamber passes by the opening of the conduit to pressurize the chamber and thereby contact the tobacco material contained in the chamber. As the following vane passes the opening of the conduit 320, communication of the chamber with the conduit is interrupted, and tobacco material (e.g., tobacco material impregnated with the fluid) is released from the rotary lock.

The various types of apparatus of the present invention are operable at high pressures, hence tobacco material extraction, impregnation, or other treatment can be conducted at or above the critical state conditions for many solvents. Critical state conditions are those conditions of temperature and pressure at which the density and other physical properties of a liquid and gas become identical and the phase boundary present between liquid and gas at subcritical conditions disappears. Above the critical temperature, no amount of increase in pressure will result in liquefaction of a dense gas. It is well known to those skilled in the art that dense, high pressure supercritical gases at conditions near critical temperature exhibit a significant solvent power, and solute concentration in such a supercritical or dense gas phase can be as much as several orders of magnitude greater than the concentration that could be predicted at a given temperature from Dalton's law of partial pressure. Accordingly, taking advantage of this phenomenon by using fluids at conditions of temperature and pressure above critical state conditions, substances that are normally considered to be non-volatile at lower gas density can be readily extracted. However, as those of ordinary skill in the art will recognize, the apparatus can be advantageously used at other conditions.

Extraction using dense gases differs from typical liquid extractions in several respects. For example, although having a density comparable to that of a liquid, dense gas diffusivity and permeability can be 10 times that of the liquid or more, allowing the system to reach near equilibrium conditions in a short period of time, thereby reducing the actual extraction time for the process. Extraction time, or dwell time (i.e., the usually predetermined time that the tobacco material remains in contact with extraction solvent or impregnant), can also be controlled by varying the flow rate of the solvent taking into consideration the short time necessary to achieve equilibrium. Additionally, in the supercritical pressure range, a small change in pressure or temperature can significantly alter dissolution of substances present in tobacco material. For most substances there is a maximum solubility of the substances at some density and temperature of the supercritical solvent so that at higher densities solubility may decrease. Either too high or too low a pressure can reduce the ability of a solvent to extract selected components. Accordingly, a pressure program can be useful in controlling extraction for many components by processing the tobacco material through the system to obtain different fractions.

However, while in a limited sense solubility for some substances in dense gases can be predicted through the theoretical calculations, neither pressure nor density of certain gases appears to assure the possibility for specific extraction of selected substances of tobacco material. The specific molecular interactions between molecules of the solvent and the molecules of extracted substances plays an important role in the extraction process. For example, nicotine is sometimes extracted from tobacco material, and is present in tobacco material in a variety of forms, some easily extracted and some present as complex salts that are more difficult to remove due to their low solubility in supercritical fluids. In order to facilitate nicotine extraction from tobacco material with supercritical gases, tobacco material can, for example, be subjected to an ammoniation step prior to nicotine extraction. Furthermore, tobacco materials of different origins behave differently. Use of specific solvents and process conditions for specific extractions may therefore have to be determined empirically. Nevertheless, extraction using supercritical gases generally provides a more selective extraction than extraction using solvent at subcritical or liquid conditions.

Tobacco material contains thermally sensitive sugars, oils, and other flavor components. The solvent, whether at subcritical or supercritical conditions, should exhibit sufficient extraction power at a desirable temperature to accomplish the desired extraction in a reasonable period of time. By appropriate choice of solvent and process conditions, the use of potentially harmful heat to extract substances from tobacco material can be minimized or eliminated so that the flavor characteristics of the extracts can be preserved. However, heat can be advantageously applied to modify or develop certain flavor characteristics, when desired. An extraction solvent with favorable critical parameters can be used for selective extraction of both thermally labile substances and substances that are normally of low volatility. The temperature of the solvent is preferably low enough not to harm the tobacco material, and yet in the range of 10° to 30° F. above the critical temperature. Preferred extraction solvents are therefor those whose physical parameters, including critical temperature and pressure, enable extraction, especially selective extraction, with changes in pressure (density) of the fluid, and whose critical temperatures are low enough to not adversely affect tobacco material quality. These considerations will vary depending on the origin of the tobacco material, the process conditions, the chemical nature of the solvent, and the substances sought to be extracted.

In most processes for extraction of tobacco material, it is generally desirable to separate the extract from the extract-laden solvent, both for recovery and recycle of solvent and for recovery of substances extracted from tobacco material. Under these conditions the solvent should be easily separated from the tobacco material extract with minimal effect on the flavor characteristics thereof. Essentially any conventional recovery method can be used. For processes conducted at supercritical gas conditions, separation can be effected by lowering the temperature and/or pressure of the extract laden solvent. Also useful are separation techniques using isobaric and isothermal adsorption onto sorbents for recovery of sensitive compounds. A series of adsorbents or a multistage pressure cascade can be employed to achieve fractionation effects, especially for separation where the extract laden solvent is a liquid. The solvent can be stripped of any remaining extract to further purify it by using known methods including adsorption onto charcoal of the tobacco material extract. Extract-free solvent can then be recirculated to the tobacco material extraction zone at high pressure. Additionally, it will often be desirable to recover the extracted tobacco material, which may be tobacco material cut filler, tobacco material leaf, or other valuable tobacco materials, so the solvent should separate from the extracted tobacco material with minimal effect on the integrity thereof.

Illustrative compounds useful as extraction solvents include: ammonia; argon; carbon dioxide; nitrous oxide; sulfur hexafluoride; the ketones; aliphatic or cyclic ethers; aliphatic alcohols; esters; aliphatic hydrocarbons, including methane, ethane, propane, butane, pentane, isopentane, hexane, and the corresponding unsaturated hydrocarbons such as 1-butene, cis-2-butene, trans-2-butene, 1,3-butadiene; the cycloaliphatic hydrocarbons, including cyclopropane, cyclobutane, cyclohexane and cyclopentane; the halohydrocarbons having up to about 4 carbon atoms, including ethyl chloride, propyl chloride, isopropyl chloride, sec-butyl chloride, t-butyl chloride, methylene chloride, chloroform, carbon tetrachloride, ethylene dichloride, ethylidene chloride, methyl bromide, ethyl bromide, t-butyl bromide; and the fluorocarbons, including perfluoropropane, octafluorocyclobutane, tetrafluoromethane, bromotrifluoromethane, 1,1,2,2-tetrafluorochloroethane, 1,1-difluoroethylene, fluorodichloromethane, trifluorochloroethylene, 1,1,1-trifluoroethane, dichlorotrifluoroethane, trifluoroethylene, trichloromonofluoromethane, dichlorodifluoromethane, monochlorodifluoromethane, 1,1-difluoroethane, and trichlorotrifluoroethane. Mixtures of these solvents may be useful. Co-solvents including alcohols, ammonia, or water may be added to these solvents in a range of from 0.5 to 10% by weight to enhance extraction or to modify the extracted components.

Especially preferred extraction solvents are low-boiling, highly volatile compounds that have a critical temperature in the range of 85° to 315° F., or even more preferably 90° to 250° F. However, higher temperatures may be used when it is desired to subject the tobacco material to heat treatment during the extraction process to modify flavor characteristics of the tobacco material. Preferred dense gas (supercritical) extraction solvents include sulfur hexafluoride; carbon dioxide; nitrous oxide; ammonia; the light hydrocarbons, including ethylene, ethane, propane, propylene, n-butane, isobutane; and the halogenated hydrocarbons (halocarbons), including perfluropropane, Refrigerant 12 (dichlorodifluoromethane), and Refrigerant 22(monochlorodifluoromethane) or mixtures thereof.

Mixtures of extraction solvents, such as carbon dioxide and propane or others, are also useful at normal liquid and at dense gas conditions. However, it is usually preferred to use a relatively pure solvent containing at least about 90 to 95% of one compound. Critical values of temperature and pressure and the relationship among pressure, volume, and temperature for mixtures may be estimated with reliable accuracy through various equations of state and associated mixing rules, including the Redlich-Kwong, Lee-Kessler, and Peng-Robinson equations of state, using the methods described in, respectively, O. Redlich and J. N. S. Kwong, Chem. Rev. 44, 233 (1949); I. K. Lee and M. G. Kessler, AICHE J. 21, 510 (1975); and D. Y. Peng and D. B. Robinson, AICHE J. 23, 137 (1977). See also the methods described in the *Chemical Engineers' Handbook* (Perry, Robert H. and Cecil H. Chilton, eds. 5th Ed. 3-227 et seq. New York: McGraw-Hill Publishing Company 1973).

The amount of tobacco material that is contacted with the extraction solvent can vary. Typically, for a liquid extraction, the weight of extraction solvent relative to the tobacco material is greater than about 4:1, oftentimes greater than about 8:1 and in certain instances greater than about 12:1. For a subcritical gaseous expansion, the weight of extraction solvent relative tobacco material is typically greater than 12:1, and for a supercritical gaseous expansion, the weight of extraction solvent relative to tobacco material is greater than 40:1, oftentimes greater than 50:1, and can be greater than 100:1. The amount of solvent relative to tobacco material depends upon factors such as the type of solvent, the temperature at which the extraction is performed, the type or form of tobacco material which is extracted, the manner in which contact of the tobacco material and solvent is conducted, the type of extraction process which is performed, and other such factors. The manner for contacting the tobacco material with the extraction solvent is not particularly critical, and as such, the tobacco material can be extracted in the continual or batchwise manner of the present invention.

The process and apparatus of this invention can be applied to raw tobacco material, treated tobacco material, or cured tobacco material in the form of leaf (including stems, ribs, and veins), strips (leaf with the stems removed), cigarette cut filler (strips cut or shredded for cigarette making), or fines. The present invention is useful for extracting components from virtually all forms of tobacco material and is capable of preserving the integrity of extracted tobacco material and the organoleptic characteristics of extracts. Nevertheless, these characteristics can be altered if desired. According to the present invention, a preferred tobacco material is of a form such that, under extraction conditions, i) a portion thereof is soluble in (i.e., extracted by) an extraction solvent, and ii) a portion thereof is insoluble in (i.e., not extracted by) the extraction solvent. Typical extracted tobacco materials include components of the biopolymer matrix of the tobacco material and other tobacco material components that are not extracted by the solvent. Usually, an extracted tobacco material, treated and removed from the chamber, has at least one component removed therefrom.

Those practitioners skilled in the art of tobacco material processing will recognize that the moisture content of tobacco material can impact the selectivity of a solvent for the components of tobacco material. For example, it is known that supercritical carbon dioxide extracts far more nicotine from moist tobacco material than it does from dry tobacco material at the same process conditions. Accordingly, the moisture content of the tobacco material should be adjusted to optimize the desired extraction. Additionally the tobacco material to be treated should be in a pliable condition to minimize breakage or shattering during handling and processing, especially if the tobacco material is subjected to an expansion step after extraction. The traditional way of making tobacco material pliable is to adjust the moisture content to within the range of from about 8 to about 40 percent water on a dry weight basis, which is generally satisfactory for extraction. A moisture content of 10 to 25 percent normally is preferred, although more moisture, even up to 40 percent, may be required to reduce the production of fines that can sometimes occur during processing. A moisture content of 25 to 35 percent is normally preferred for extraction of nicotine with selected solvents. For the extraction of certain essential oils the tobacco material may require less moisture content. For example, at a moisture content of 10 to 13 percent, supercritical carbon dioxide can extract certain flavor components of a tobacco material but not a significant amount of nicotine. At higher moisture content, above about 19 percent, nicotine will be extracted more efficiently in sufficient quantity.

Operating the apparatus of the invention, especially at supercritical conditions, requires a high performance seal. A high performance seal provides for essentially no leakage during conditions of normal use of the apparatus. The performance of a seal depends upon factors such as (i) a sufficiently great clamping or compressive force maintaining the intimately contacting surfaces in contact, and (ii) a sufficiently great seal width. The clamping force depends upon the size (e.g., the diameter) of the opening or passageway through the seal, and typically is at least about 400 to about 500 pounds force per square inch per square inch of opening when used to seal a fluid at a pressure of about 300 psig. The minimum seal width necessary to prevent leakage for a fluid pressurized at about 2,000 psig typically is at least about 0.5 inch, frequently between about 0.75 inch and 1.0 inch, for a dynamic seal manufactured from advanced structural ceramic materials. As the size of the opening or passageway increases, the minimum seal width and clamping force may also increase to provide an adequate seal. Typical high pressure and high performance seals often are manufactured from materials which undergo some deformation (i.e., deformation (i) due to the high compressive forces applied thereto, and (ii) because seals normally conform to the shape of the surface they are sealing). However, a preferred high performance seal for purposes of this invention is a dynamic seal. Such a seal, during conditions of normal use of the apparatus, (i) provides for essentially no leakage, and (ii)

has contacting surfaces which can be moved relative to one another. Thus, it is desirable for a high performance dynamic seal to (i) have an ability to substantially preserve its shape under relatively high compressive forces, and (ii) have a smooth, flat surface to achieve sufficient contact between the respectively moving surfaces.

Abrasive material typically present in tobacco material normally destroys conventional pressure seals in continuous tobacco material processes even at low pressures. It has been found, however, that planar and nonplanar high precision fitted surfaces of sufficient hardness to withstand abrasion that are 1) in surface-to-surface contact, and 2) are sufficiently fitted to provide a seal against significant fluid leak when subjected to a clamping force, will allow a stable high pressure treatment of a continual flow of tobacco material even when in relative movement. Advanced structural ceramic materials provide these surfaces.

Advanced structural ceramic materials that are useful in the present invention are made using ceramic powders of alumina, zirconia, silicon nitride, silicon carbide, aluminum nitride, boron carbide, titanium diboride, aluminum titanate, tungsten carbide, and mixtures and combinations of the same and the like. These powders are typically mixed with a binder, molded, and fired at high temperature and pressure, reaction bonded, scintered, hot pressed, or otherwise formed into solid bodies of advanced structural ceramic materials. Particularly useful advanced structural ceramic materials useful in the practice of the present invention are available from Coors Ceramic Company in Golden, Colo. Two such advanced structural ceramic materials comprised of alumina are designated by Coors as AD-90 and AD-99.5. Additionally, these materials may presently be obtained in a form suitable for use in the present invention by special order from Coors. Advanced structural ceramic materials, including a hot pressed silicon nitride, are also available from Garrett Processing Company, Torrence, Calif.

Advanced structural ceramic materials such as are listed above have several properties that render them particularly suitable relative to metal materials for use as dynamic seals in tobacco material expansion apparatus and processes. Advanced structural ceramic materials, particularly silicon nitride, typically have a low coefficient of thermal expansion, a lower coefficient of friction relative to steel, and advanced structural ceramic materials typically maintain their shape to a much higher degree than steel materials during movement under a compressive load, (i.e., selected advanced structural ceramic materials are dimensionally stable). Further, advanced structural ceramic materials are characterized by a high degree of wear resistance, typically eight times or more greater than hardened tool steel. Additionally, advanced structural ceramic materials are hard, mechanically strong at high temperatures, and relatively stiff for their weight. Advanced structural ceramic materials also have great compressive strength and adequate tensile strengths and fracture toughness, especially when used as a reinforced composite, for usage in seal applications. Finally, advanced structural ceramic materials resist the corrosive action of solvents, such as are used in tobacco material extraction. See S. J. Schneider, Jr. and D. R. Bradley, "The Standardization of Advanced Ceramics," Adv. Ceram. Mat'ls., Vol. 3, No. 5, 1988 at 442; J. P. Singh, K. C. Goretta, D. S. Kupperman, J. L. Routbort, and J. F. Rhodes, "Fracture Toughness and Strength of SiC-Whisker-Reinforced $Si_3N_4$ Composites," Adv. Ceram. Mat'ls., Vol. 3, No. 4, 1988, at 357.

Advanced structural ceramic materials have a hardness typically greater than 900 kg/mm$^2$, often greater than 1,000 kg/mm$^2$, still more frequently greater than 1,400 kg/mm$^2$, even greater than 1,500 kg/mm$^2$, and typically in a range of from at least about 900 kg/mm$^2$ to at least about 3,000 kg/mm$^2$. For example, an advanced structural ceramic material comprised of 85% alumina has a hardness of about 960 kg/mm$^2$. An alumina based advanced ceramic structural material such as Coors' AD-90, which is 90 percent alumina, has a hardness of about 1058 kg/mm$^2$; AD-99.5, about 1440 kg/mm$^2$. Hardness also depends on the ceramic powder from which the advanced structural ceramic material is made. Advanced structural ceramic materials comprised of hot pressed silicon nitride typically have a hardness of about 1,500 kg/mm$^2$; silicon carbide, about 2,500 kg/mm$^2$; boron carbide, about 3,000 kg/mm$^2$.

Advanced structural ceramic materials have a compressive strength typically greater than at least about 1,900 MPa at 20° C. as determined by ASTM C773-82. For most applications, a compressive strength of greater than about 2,000 MPa is desirable, often greater than 2,500 MPa, and, for certain applications greater than 3,500 MPa, and typically in the range of from at least about 1,900 MPa to about 6,000 MPa. Advanced structural ceramic materials comprised of alumina typically have compressive strengths of 1,930 to 4,000 MPa; of tungsten carbide, about 5,000 MPa. Coors' AD-90 has a compressive strength of about 2,482 kg/mm$^2$; AD-995, about 2,620 kg/mm$^2$. Advanced structural ceramic materials have a high stiffness to weight ratio that enables them to function well as dynamic seal components at high pressures, including supercritical gaseous pressures. Typically, advanced structural ceramic materials have a stiffness at 20° C. of greater than 30 GPa/g/cc, preferably greater than 40 GPa/g/cc, still more preferably greater than 70 GPa/g/cc, and typically in the range of from greater than about 30 GPa/g/cc to about 140 GPa/g/cc.

Advanced structural ceramic materials typically have an adequate tensile strength to provide sealing surfaces for the dynamic seal of the present invention. Tensile strength is determined in accordance with ACMA No. 4 to be at least about 100 MPa. Typically, for most applications, a tensile strength of at least about 125 MPa is desirable, more preferably greater than 150 MPa, frequently greater than 200 MPa or more, and typically in the range of from 100 to 400 MPa or more. An advanced structural ceramic material comprised of about 85 percent alumina typically has a tensile strength of about 155 MPa; 90 percent alumina, about 221 MPa; 99.5 percent alumina, about 262 MPa; and 99.9 percent alumina, about 310 MPa. Advanced structural ceramic materials comprised of silicon carbide typically have a tensile strength of about 307 MPa, while that comprised of zirconia typically has a tensile strength of about 352 MPa.

Fracture toughness for advanced structural ceramic materials, as determined by the notched beam test, typically ranges from at least about 3 MPa.m$^{\frac{1}{2}}$ to about 35 MPa.m$^{\frac{1}{2}}$ and is adequate to provide sealing surfaces for the dynamic seal of the present invention. Tensile strengths above 10 MPa.m$^{\frac{1}{2}}$ are preferred and above 15 MPa.m$^{\frac{1}{2}}$ are especially preferred. Solid bodies formed from advanced structural ceramic materials can be reinforced with materials such as ceramic crystals, also known as whiskers, to increase fracture toughness and mechanical strength. One example of a whisker reinforced advanced structural ceramic material is alumina reinforced with silicon carbide whiskers.

Also of considerable importance, the surface of an advanced structural ceramic material can be ground and polished using diamond slurries to a finish having a low friction coefficient that enables it to be turned easily with or without lubrication (i.e., added lubricants) under high pressure loads. The coefficient of static friction for the finished surface of a polished advanced structural ceramic material is typically lower than that of steel materials, and is usually less than 0.6, preferably less than 0.4, and most preferably less than 0.3. Advantageously, no lubricant is required that might contaminate the tobacco material. The surface finish, or smoothness, measured in microinches (Roughness average, Ra), of the polished advanced structural ceramic material used in the process of the present invention is less than at most about 70 microinches, preferably less than 32 microinches, more preferably less than 16 microinches, and especially preferred is 2 to 6 microinches.

The surface of an advanced structural ceramic material can also be made flat, optically flat, to less than at most about 70 microinches, and it is preferred that the surface be made optically flat to less than about 40 microinches, more preferably to between 5 to 20 microinches, particularly for high pressure applications. Coors AD-90 and AD-995 finished advanced structural ceramic materials have been furnished by Coors with the requisite smoothness and flatness. Further finishing by lapping of two components made from advanced structural ceramic materials to fit them together and obtain the surface flatness and smoothness to the degree required is not necessary but will work as will be apparent to the skilled artisan. When two such flat and smooth surfaces come into sufficiently clamped contact and are properly supported, they will maintain the pressures required for the operation of this process while requiring an acceptable level of effort for movement of one surface over another. Equipment for determining whether a sealing surface of the advanced structural ceramic material component part meets the specified requirements for flatness is available from the Van Keuren Company, Watertown 72, Mass. The VK Precision Measuring Tools Catalog and Handbook No. 36, ©1955, catalogs tools called "optical flats" for this purpose. Additionally, laser interferometer techniques can be employed.

The force required to rotate or slide one contacting surface over another (a force sufficient to overcome friction between the surfaces) depends on the clamping force, or load, that is applied, on the surface finish, and upon the material of which the surfaces are made. The clamping force required to hold two components made from advanced structural ceramic materials together depends on the gas pressure in the system and the cross-sectional area of the aperture in the advanced structural ceramic plate. For example, components used in the present invention may require a rotational torque of about 130 foot pounds, applied through a suitable 10:1 ratio transmission while maintaining a stable fluid pressure of 1700 psig, and while being slidably rotated across a sealing area of about 19 square inches. Accordingly, mechanical design of a driving mechanism for turning the "slidably engaged" components is not hindered.

The process and apparatus of this invention are not limited to extraction of substances from tobacco material. Additionally, the process and apparatus of this invention provide an effective and efficient manner in which to produce an expanded tobacco material product (e.g. a tobacco material having increased filling capacity), either in combination with a tobacco material extraction or as a separate process. Normally, the tobacco material is in cut filler form when subjected to expansion conditions. As a separate process, the expansion agent typically is removed from the treatment chamber or cell impregnated in the tobacco material, and not removed separately. Many of those extraction solvents listed hereinbefore, and combinations of those solvents, also serve as good expansion agents. The expansion agent can be employed in a gaseous or liquid state when used to impregnate the tobacco material during the expansion process.

The tobacco material to be expanded should be in a pliable condition to minimize breakage or shattering during handling and processing. Typically, the tobacco material is made pliable by adjusting the moisture content to within the range of from about 8 to about 35 percent water on a dry weight basis. A moisture content of 10 to 20 percent normally is preferred, although more moisture may be required to reduce the production of fines that can sometimes occur during expansion, especially when the expansion process subjects the tobacco material to large and extremely fast pressure changes. Little moisture should be lost from the tobacco material during impregnation and expansion, and in certain circumstances the moisture content usually is reduced only about 2 to 4 percent or less during such processing. Often, a tobacco material having a moisture content of about 12 to 20 percent will provide expanded tobacco material of suitable moisture content for cigarette making without the need for further moisture adjustment. Depending upon the moisture content of the tobacco material and processing conditions experienced by the tobacco material, the expanded tobacco material can be dried or reordered to provide that material at a desired moisture content.

It is also preferred to conduct the expansion process of this invention at or near supercritical gas conditions, when possible. An important characteristic of a supercritical gas from the perspective of tobacco material expansion processes is its density. Although having a density comparable to that of a liquid, dense gas diffusivity and permeability is up to 10 times greater, allowing for better mass transfer. In tobacco material expansion, this means that the individual tobacco material particles are impregnated thoroughly at a very fast rate. In addition, the impregnation pressure for a given tobacco material expansion agent will be much greater than if ordinary gas conditions are employed. This means that the volume of the dense, supercritical gas is as much as several orders of magnitude lower than the same mass of that gas in an expanded state. Accordingly, the degree of expansion achieved in supercritical gas processes can be greater than is achieved in certain conventional processes.

As an example of an expansion process of the present invention analogous to the extraction process previously described, discreet portions of tobacco material enter an impregnation zone of a jacketed treatment chamber containing a pressurized fluid described previously, with reference to FIG. 1. Tobacco material advances through the chamber and that material is treated to become thoroughly impregnated with pressurized expansion agent. At the exit mechanism, advancing tobacco material fills a cell in pressure-tight communication with the impregnation zone. When filled, the cell is indexed to discharge the impregnated tobacco material to a low pressure (i.e., about ambient pressure) expansion chamber. If desired, the impregnated tobacco material can be subjected to high temperature treatment (i.e., contacted with hot air or steam) in the expansion chamber. As such, a significant amount of expansion agent is removed from the tobacco material. Expansion may be accomplished through pressure reduction, the application of heat, or a combination of the two. The low-pressure expansion chamber includes an ordinary separator, such as a cyclone separator, where the expanded tobacco material is separated from expansion fluid. Each of the expanded tobacco material and the expansion fluid are recovered separately. The separated impregnating fluid, in the form of an expanded gas, is discharged from the expansion zone through a conduit where it can be recovered, if desired. While expansion fluid is continually discharged through a conduit, expansion fluid make-up is continually supplied through another conduit to the impregnating chamber. Expanded tobacco material is discharged through the bottom of the separator, where it will be recovered for further treatment, including reordering, if necessary.

Expansion agents that may be used in accordance with this invention are those agents that impregnate the bulk of the tobacco material to thoroughly permeate the cellular structure of the tobacco material and cause expansion of that cellular structure when pressure experienced by the pressurized agent is reduced. The pressure reduction may be accomplished by post heating of the material. While the cellular structure is expanded, the overall physical integrity of the tobacco material generally remains unaltered. Additionally, in certain circumstances, the expansion agent will generally be "inert" so as to minimize significant changes in the chemical composition of the tobacco material, and will not produce undesirable components within the tobacco material in meaningful amounts. The ideal expansion agent thoroughly impregnates the tobacco material in a relatively short dwell or residence time at a desirable temperature, achieves a significant degree of expansion of the tobacco material particles without shattering when process conditions change, and is easy to separate from the tobacco material with minimal affect on flavor. The ability of an expansion agent to perform this task depends upon the chemical nature of the expansion agent and the conditions of pressure and temperature at which an expansion process using that agent can be run. For example, if the pressure is reduced by a large amount too quickly, shattering may result. Normally, pressure changes of less than about 2500 psig are preferred to provide expansion without shattering when pressure is quickly reduced; however, those skilled in the art of tobacco material expansion will recognize that significantly higher pressures can be used. Partial pressure discharges, usually greater than 300 psig, (e.g., discharges to zones of successively lower pressure) are useful to lower the pressure to an acceptable level to expand tobacco material without shattering when high pressure impregnation is desired.

Generally speaking, suitable expansion agents according to the present invention have an atmospheric pressure boiling point in the range of about −130° to about 176° F. Compounds having boiling points above about 176° F. do not generally provide good tobacco material expansion and are sometimes difficult to remove completely from the tobacco material without adversely affecting its flavor and aroma. Many of the compounds mentioned above in connection with extraction of substances from tobacco material as useful extraction solvents are also useful as expansion agents. Especially preferred are low boiling and highly volatile compounds with critical temperatures of from about 85° F. to about 315° F., and more preferably, from about 90° F. to about 250° F.

One consideration regarding the choice of expansion agent and the process conditions of temperature and pressure, however, as in the case of extraction, is that tobacco material contains thermally sensitive sugars, oils, and other flavorful constituents. The temperature and pressure can affect not only the impregnation of the tobacco material by the expansion agent, but also the transfer of tobacco material substances to a particular expansion agent. Too high a pressure or temperature can increase the solvent power of the expansion agent such that valuable tobacco material substances that are desirably retained in the tobacco material appreciably dissolve in the expansion agent. Accordingly, in the process of this invention, the temperature and pressure conditions and the flow rate of the tobacco material should be set to optimize expansion while minimizing adverse affects on tobacco material quality, including transfer of substances that are desirably retained. On the other hand, temperature and pressure can be controlled to cause an extraction of some substances from the tobacco material in combination with expansion, when desired.

More specifically, the temperature of the expansion agent when impregnated within the tobacco material should be low enough not to harm (i.e., undesirably alter the physical and flavor characteristics of) the tobacco material, and often in the range of between 36° F. below the critical temperature of the expansion agent to about 75° F. above the critical temperature of the expansion agent. The pressure experienced by the expansion agent during impregnation is advantageously above about 64 psig below the critical pressure of the expansion agent to provide the requisite density and diffusivity. Pressure often is at least about 500 psig, preferably above about 800 psig, and most desirably above about 1000 psig depending on the expansion agent. However, pressure above about 50 psig can be employed using expansion agents such as butane. Due to the great rate of pressure release that can be provided using the apparatus of the present invention, it is often possible to conduct impregnation of tobacco material using expansion agents at relatively low impregnation pressures. Tobacco material can be expanded by this process to a satisfactory extent without excessive fracturing by using suitable pressures below about 3000 psig, so higher pressures usually are not needed.

Complete impregnation of the tobacco material, especially for fluids such as propane and the like, is virtually instantaneous. Somewhat greater expansion of the tobacco material can be achieved by maintaining the pressure for a brief dwell time of from about one to 10 minutes before initiating depressurization, preferably 2 to 4 minutes depending on the expansion agent. Depressurization is carried out at a relatively fast rate so that the pressure is reduced to or near atmospheric pressure within a time period of less than 10 minutes, preferably about 1 to 300 seconds, optimally less than 10 seconds.

While the phenomenon by which expansion occurs is not fully understood, it is believed that the most effective expansion of tobacco material is achieved when at least a portion of the expansion agent is transformed to the liquid or condensed phase in the tobacco material during depressurization, and subsequently vaporizes as the pressure is further reduced and heat is applied. It is not known at what point during the process expansion of the tobacco material occurs, but it is believed to begin during depressurization. When using a low boiling liquid as the impregnation agent, such as the freons, $CO_2$, propane, butane, sulfur hexafluoride, ethanol, nitrogen, or others, a rapid (e.g., 5 to 20 second) post-heating step may be necessary for quick conversion of liquid into gas. Sometimes, for impregnation processes conducted at supercritical gaseous conditions, no heating step will be required after decompression to expand the tobacco material or to fix it in an expanded state (i.e., when an agent such as propane is employed), although heating may be used when desirable (i.e., when an agent such as $CO_2$ is employed). After depressurization, surprisingly, tobacco material is found in expanded condition without significant damage to the cellular structure, its filling capacity having been increased by 50% or more. Filling capacity increases of over 100% and even up to 150% and more can be achieved by using the previously described expansion process.

By careful choice of an extraction solvent and process conditions of temperature and pressure, the extraction solvent can serve as an expansion agent so that expansion can occur on release of tobacco material from the extraction zone. It will be recognized that the ability of a compound to serve as a useful extraction solvent depends on different parameters than does the utility of an expansion agent. Certain conditions of temperature, pressure, density, moisture, and the origin of the tobacco material can result in undesirable extractions. Hence, the conditions useful for extraction of particular substances and the expansion of tobacco material should be similar if one substance is to act as both solvent and expansion agent. Generally, these conditions should be empirically determined.

It should be recognized that the apparatus and process of the present invention has a broad range of applications that serve a variety of purposes. As previously stated, the process and apparatus can be used to extract substances from tobacco material using an extraction solvent at either supercritical gaseous conditions or at liquid conditions depending on the results desired. One of skill in the art of extraction should recognize that the process and apparatus of the present invention is widely applicable to a variety of extractions including extraction of substances from tobacco material and other biological materials. Explosive shattering through a rapid pressure drop can be used for particle size reduction, modification of a material, and separation of components. For example, impregnation of the cells of tobacco materials and other biological materials including bacteria with a fluid under sufficient conditions of pressure, followed by a controlled rapid pressure drop, can be useful for enhancing extraction of biological components by disrupting the internal cellular structure of the impregnated material, facilitating release of valuable substances. Additionally, tobacco material and other biological components can be heat treated at controlled conditions of either high or low pressure, including vacuum pressure. Yet another application of the present invention is in ammoniating tobacco material at a relatively fast rate. Many of these processes can be combined to produce a variety of desired results, such as ammoniation of tobacco material, extraction of moisture, and expansion of the extracted tobacco material.

One particular benefit of the process and apparatus of the present invention resides in that high pressure treatment of biological materials, including tobacco material, can be conducted in a manner that preserves the integrity of the treated material. For example, in tobacco material extraction, as in some other types of extractions, the extracted material is valuable and it is desirable to recover this material in the same form it had prior to treatment. Accordingly, tobacco leaf material can be treated to extract substances therefrom, and tobacco leaf material can be recovered rather than an amorphous, extruded extracted tobacco material. Such nondestructive treatment of solids, especially in a continuous process is a highly beneficial aspect of the present invention.

The invention has been described in considerable detail with specific reference to preferred embodiments. However, variations can be made within the spirit and scope of the invention as described in the foregoing specification and defined in the appended claims.

That which is claimed is:

1. A process for altering the character of a material, the process comprising the steps of:
(a) introducing a material into a chamber;
(b) sealing the chamber with at least one dynamic seal having components providing cooperating movable surfaces for sealing the chamber and for introducing material into and removing material from the chamber;
(c) introducing a fluid into the chamber at controlled conditions of pressure of at least about 350 psig;
(d) moving at least one component of at least one seal, the seal substantially preventing leakage of fluid at a pressure of at least 350 psig; and
(e) removing treated material from the chamber.

2. A process for altering the character of a material, the process comprising the steps of:
(a) introducing a material into a chamber;
(b) sealing the chamber with at least one dynamic seal having components providing cooperating movable surfaces of advanced structural ceramic materials for sealing the chamber and for introducing material to and removing material from the chamber;
(c) introducing a fluid into the chamber at controlled conditions of pressure;
(d) moving at least one component of at least one seal, the seal substantially preventing leakage of fluid; and
(e) removing treated material from the chamber.

3. A process for altering the character of a material, the process comprising the steps of:
(a) introducing a material into a chamber;
(b) sealing the chamber with at least one dynamic seal having components providing cooperating movable surfaces having a hardness of at least about 900 $kg/mm^2$ and a flatness of less than about 70 microinches for sealing the chamber and for introducing material to and removing material from the chamber;
(c) introducing a fluid into the chamber at controlled conditions of pressure;

(d) moving at least one component of at least one seal, the seal substantially preventing leakage of fluid; and (e) removing treated material from the chamber.

4. The process of any of claims 1, 2, or 3 wherein the process is performed in a batchwise manner; step (a) occurs prior to step (b); step (b) occurs prior to step (c); step (c) occurs prior to step (d); after step (d) and prior to step (e) there occurs the additional step of unsealing the chamber.

5. The process of claims 2 or 3 wherein the process is a batchwise process, and steps (b), (c), and (d) occur in order prior to step (a).

6. The process of any of claims 1, 2, or 3 wherein the process is a continual process; steps (b), (c), and (d) occur in order prior to step (a); and at least two dynamic seals seal the chamber, at least one dynamic seal having cooperating movable surfaces for sealing the chamber and for introducing material into the chamber, and at least one other dynamic seal having cooperating movable surfaces for sealing the chamber and for removing material from the chamber, the dynamic seals cooperating with the chamber and with cells for, respectively, the continual introduction into and removal from the chamber of material.

7. The process of any of claims 1, 2, or 3 wherein, while material is introduced to the chamber in accordance with step (a), treated material is being removed from the chamber in accordance with step (b).

8. The process of any of claims 1, 2, or 3 wherein treated material is removed from the chamber in accordance with step (d) while material remains in the chamber.

9. A process for altering the character of a material with a fluid comprising the steps of:

(a) introducing a material into a cell;

(b) sealing the cell with a dynamic seal having cooperating movable surfaces for introducing material into and removing material from the cell;

(c) introducing a fluid into the cell under controlled conditions of pressure of at least about 350 psig;

(d) maintaining the seal in a dynamic state while the conditions of pressure within the cell are controlled, the seal substantially preventing fluid leakage from the cell at pressures of at least 50 psig;

(e) unsealing the cell; and (f) removing treated material from the cell.

10. A process for altering the character of a material with a fluid comprising the steps of:

(a) introducing a material into a cell;

(b) sealing the cell with a dynamic seal, the seal having components having cooperating movable surfaces comprising advanced structural ceramic materials for introducing material into and removing material from the cell;

(c) introducing a fluid into the cell under controlled conditions of pressure;

(d) maintaining the seal in a dynamic state while the conditions of pressure within the cell are controlled, the seal substantially preventing fluid leakage;

(e) unsealing the cell; and (f) removing treated material from the cell.

11. A process for altering the character of a material comprising the steps of:

(a) introducing a material into a cell;

(b) sealing the cell with a dynamic seal, the seal having components having cooperating movable surfaces of a hardness of at least about 900 kg/mm$^2$ and a flatness of less than about 70 microinches for introducing material into and removing material from the cell;

(c) introducing a fluid into the cell under controlled conditions of pressure;

(d) maintaining the seal in a dynamic state while the conditions of pressure within the cell are controlled, the seal substantially preventing fluid leakage;

(e) unsealing the cell; and (f) removing treated material from the cell.

12. A process for altering the character of a material with a fluid comprising the steps of:

(a) introducing a material into a cell;

(b) sealing the cell with the components of a dynamic seal, the components having cooperating movable surfaces, the components cooperating with the cell and with a treatment chamber sealed by the components and pressurized to at least about 50 psig, the components substantially preventing fluid leakage from the cell and chamber at pressures of at least 50 psig;

(c) placing the cell into pressure communication and material communicable relation with the treatment chamber;

(d) charging the material into the treatment chamber;

(e) treating the material while in the chamber;

(f) removing the treated material from the treatment chamber to a cell that is in pressure communication and material communicable relation with the treatment chamber, the cell and chamber being sealed with the components of a dynamic seal, the components cooperating with the cell and chamber to substantially prevent fluid leakage from the cell and chamber at pressures of at least 50 psig;

(g) removing the cell of step (f) from communication with the treatment chamber; and (h) discharging treated material from the chamber.

13. A process for altering the character of a material comprising the steps of:

(a) introducing a material to be treated into a cell;

(b) sealing the cell with the components of a dynamic seal, the components having cooperating movable surfaces, the components being comprised of advanced structural ceramic materials, the components cooperating with the cell and with a treatment chamber sealed by the components and containing a fluid at controlled conditions of pressure, the seal components substantially preventing fluid leakage;

(c) placing the cell into pressure communication and material communicable relation with the treatment chamber;

(d) charging the material to be treated into the treatment chamber;

(e) treating the material while in the chamber;

(f) removing treated material from the treatment chamber to a cell that is in pressure communication and material communicable relation with the treatment chamber, the cell and chamber being sealed with the components of a dynamic seal, the components being comprised of advanced structural ceramic materials, the components cooperating with the cell and chamber to substantially prevent fluid leakage;

(g) removing the cell of step (f) from communication with the treatment chamber; and (h) discharging treated material from the chamber.

14. A process for altering the character of a material comprising the steps of:

(a) introducing a material into a cell;

(b) sealing the cell with the components of a dynamic seal, the components having cooperating movable surfaces, the components having a hardness of at least about 900 kg/mm$^2$ and surface flatness of less than about 70 microinches, the components cooperating with the cell and with a treatment chamber sealed by the components and containing a fluid at controlled pressure conditions to substantially prevent fluid leakage;

(c) placing the cell into pressure communication and material communicable relation with the treatment chamber;

(d) charging the material into the treatment chamber;

(e) treating the material while in the chamber;

(f) removing treated material from the treatment chamber to a cell that is in pressure communication and material communicable relation with the treatment chamber, the cell and chamber being sealed with the components of a dynamic seal, the components having a hardness of at least about 900 kg/mm$^2$ and surface flatness of less than about 70 microinches, the components cooperating with the cell and chamber to substantially prevent fluid leakage;

(g) removing the cell of step (f) from communication with the treatment chamber; and (h) discharging treated material from the chamber.

15. The process of any one of claims 1 through 3 and 9 through 14 wherein the fluid is an impregnation agent and the agent is impregnated into the material.

16. The process of any one of claims 2, 3, 10, 11, 13, and 14 wherein pressure conditions are controlled at a pressure of at least about 50 psig.

17. A process for treating tobacco material with a fluid, the process comprising the steps of:

(a) loading tobacco material into a treatment chamber through aligned apertures in contacting surfaces of first and second plates, the first plate being fastened on its opposite side to a stationary supporting member and the second plate being fastened on its opposite side to a treatment chamber, the chamber being in fixed alignment with the aperture in the second plate;

(b) closing the chamber by moving one plate relative to the other so that the apertures in the plates are no longer aligned and the contacting ceramic surface of the first plate covers the aperture of the second plate;

(c) introducing fluid at a pressure of at least about 50 psi into the closed chamber;

(d) opening the chamber by moving one plate relative to the other so that the apertures in the plates are aligned; and (e) unloading treated tobacco material from the chamber.

18. A process for treating tobacco material with a fluid, the process comprising the steps of:

(a) loading tobacco material into a treatment chamber through aligned apertures in contacting surfaces of first and second plates, at least the contacting surfaces of the plates comprising advanced structural ceramic materials, the first plate being fastened on its opposite side to a stationary supporting member and the second plate being fastened on its opposite side to a treatment chamber, the chamber being in fixed alignment with the aperture in the second plate;

(b) closing the chamber by moving one plate relative to the other so that the apertures in the plates are no longer aligned and the contacting ceramic surface of the first plate covers the aperture of the second plate;

(c) introducing fluid into the closed chamber;

(d) moving one plate relative to the other while fluid remains in the closed chamber;

(e) removing fluid from the closed chamber;

(f) opening the chamber by moving one plate relative to the other so that the apertures in the plates are aligned; and (g) unloading treated tobacco material from the chamber.

19. A process for treating tobacco material with a fluid, the process comprising the steps of:

(a) loading tobacco material into a treatment chamber through aligned apertures in contacting surfaces of first and second plates, at least the contacting surfaces of the plates having a hardness of at least about 900 kg/mm$^2$ and a flatness of at most about 70 microinches, the first plate being fastened on its opposite side to a stationary supporting member and the second plate being fastened on its opposite side to a treatment chamber, the chamber being in fixed alignment with the aperture in the second plate;

(b) closing the chamber by moving one plate relative to the other so that the apertures in the plates are no longer aligned and the contacting ceramic surface of the first plate covers the aperture of the second plate;

(c) introducing fluid into the closed chamber;

(d) moving one plate relative to the other while fluid remains in the closed chamber;

(e) removing fluid from the closed chamber;

(f) opening the chamber by moving one plate relative to the other so that the apertures in the plates are aligned; and (g) unloading treated tobacco material from the chamber.

20. The process of any one of claims 17, 18, and 19 wherein the fluid is an extraction solvent and an extract-laden solvent is removed from the closed chamber in accordance with step (e) separately from conducting step (g).

21. The process of any one of claims 17, 18, and 19 wherein the fluid is an expansion agent, step (e) is conducted simultaneously with step (g), and the treated tobacco material is expanded on removal from the chamber.

22. The process of any one of claims 17, 18, and 19 wherein the fluid is an extraction solvent that also serves as an expansion agent, an extract-laden solvent is removed from the closed chamber in accordance with step (e) separately from conducting step (g), and the treated tobacco material is expanded on removal from the chamber.

23. The process of any one of claims 17, 18, and 19 wherein the fluid is present in the closed chamber in accordance with step (c) at supercritical gaseous conditions of pressure and temperature.

24. The process of any one of claims 17, 18, and 19 wherein the fluid is present in the closed chamber in accordance with step (c) at subcritical gaseous conditions of pressure and temperature.

25. The process of any one of claims 17, 18, and 19 wherein the fluid is present in the closed chamber in accordance with step (c) at liquid conditions.

26. The process of any one of claims 17, 18, and 19 wherein the first and second plates have a plurality of apertures, and the second plate has a plurality of chambers in fixed alignment with the apertures in the second plate.

27. The process of any one of claims 18 and 19 wherein fluid is introduced into the closed chamber at a pressure of at least about 50 psig.

28. The process of any one of claims 17, 18, and 19 wherein fluid is introduced into the closed chamber at a pressure of at least about 350 psig.

29. The process of any one of claims 17, 18, and 19 wherein fluid is introduced into the closed chamber at a pressure of at least about 1100 psig.

30. The process of any one of claims 17, 18, and 19 wherein fluid is introduced into the closed chamber at a pressure of at least about 1500 psig.

31. The process of any one of claims 17, 18, and 19 wherein the fluid in introduced into the closed chamber at a pressure greater than about 2000 psig.

32. A process for treating tobacco material with a fluid under pressure, the process comprising the steps of:

(a) loading tobacco material into a treatment chamber through aligned first apertures in contacting surfaces of first and second plates to which a clamping force is applied, the first plate being fastened on its opposite side to a stationary supporting member and the second plate being fastened on its opposite side to a movable treatment chamber housing, the chamber being held within the housing in fixed contiguous alignment with the first aperture in the second plate;

(b) sealing the chamber by moving the housing in one direction so that the first apertures in the plates are no longer aligned and the contacting surface of the first plate covers the first aperture of the second plate sufficiently to form a seal;

(c) contacting the tobacco material with fluid at a controlled pressure by introducing fluid at a controlled pressure into the sealed chamber;

(d) moving the housing in the same direction as in step (b) while applying at least a minimum clamping force to substantially prevent fluid leakage between the first and second plates;

(e) removing fluid from the chamber;

(f) aligning the chamber from which pressurized fluid has been removed with a second aperture in the first plate by moving the housing in the same direction as in steps (b) and (d) to provide aligned apertures for the passage of tobacco material; and (g) unloading treated tobacco material from the chamber.

33. The process of claim 32 wherein the controlled pressure conditions are vacuum conditions.

34. The process of claim 32 wherein the movable housing is a reciprocating housing and the process includes the additional step of repeating steps (a) through (g).

35. The process of claim 32 wherein the treatment chamber housing includes more than one treatment chamber.

36. The process of claim 35 wherein at least a portion of the treatment chambers are arranged to provide for simultaneous loading and unloading of material.

37. The process of any of claims 32, 35, or 36 wherein the movable housing is a rotatively moving housing in which rotation occurs in one direction, and the process includes the additional step of repeating steps (a) through (g).

38. A method for introducing tobacco material into and removing treated tobacco material from a treatment chamber containing a pressurized fluid, the method comprising the steps of:

(a) loading tobacco material into a vessel through an aperture in a movable plate having opposed surfaces, the vessel being held on one surface of the movable plate in fixed alignment with the aperture;

(b) aligning the aperture in the movable plate with an aperture in a fixed plate having opposed surfaces, the aperture in the fixed plate communicating with a chamber for the treatment of tobacco material containing a pressurized fluid on one surface of the fixed plate, the fixed plate on its opposite surface being in continuous contact with at least a portion of the opposite surface of the movable plate, at least the contacting surfaces of the plates comprising advanced structural ceramic materials, whereby the vessel loaded with tobacco material communicates with the tobacco material treatment chamber;

(c) continuously applying at least a minimum compressing force to the plates to provide a fluid tight seal between the contacting surfaces of the plates;

(d) discharging tobacco material from the vessel into the treatment chamber, whereby tobacco material is introduced into the treatment chamber;

(e) treating tobacco material with the pressurized fluid in the treatment chamber;

(f) discharging treated tobacco material from the treatment chamber into a vessel through aligned apertures in contacting surfaces of a fixed plate and a movable plate to which at least a minimum compressing force is applied to continuously provide a fluid-tight seal between the contacting surfaces of the plates, at least the contacting surfaces of the plates comprising advanced structural ceramic materials, the movable plate being fastened on its surface opposite the contacting surface to a vessel that is held in fixed alignment with the aperture, and the fixed plate being fastened on its surface opposite the contacting surface to the treatment chamber;

(g) moving the movable plate so that the apertures are no longer aligned and treated tobacco material can be discharged from the vessel, whereby treated tobacco material is removed from the treatment chamber; and (h) discharging treated tobacco material from the vessel.

39. The process of any one of claims 1 through 3, 9 through 14, 17 through 19, 32, and 38 wherein the fluid includes carbon dioxide.

40. The process of any one of claims 1 through 3, 9 through 14, 17 through 19, 32, and 38 wherein the treatment of the material is substantially nondestructive.

41. A mechanism including a dynamic seal for use in transferring a solid material from a lower pressure zone to a higher pressure zone without substantial fluid leakage, the zones having a pressure differential of at least about 50 psig, the seal comprising cooperating movable surfaces of components that substantially prevent fluid leakage between the surfaces during movement of the surfaces with respect to one another.

42. A mechanism including a dynamic seal for use in transferring a solid material from a lower pressure zone to a higher pressure zone without substantial fluid leakage, the seal comprising components comprising advanced structural ceramic materials having cooperating movable surfaces that substantially prevent fluid leakage between the surfaces during movement of the surfaces with respect to one another.

43. A mechanism including a dynamic seal for use in transferring a solid material from a lower pressure zone to a higher pressure zone without substantial fluid leakage, the seal comprising components having a hardness of at least about 900 kg/mm$^2$ and a flatness of less than about 70 microinches, the components having cooperating movable surfaces that substantially prevent fluid leakage between the surfaces during movement of the surfaces with respect to one another.

44. The mechanism of any one of claims 41, 42, and 43, wherein the smoothness of the movable surfaces is less than 70 microinches.

45. The mechanism of any one of claims 41, 42, and 43 wherein the flatness is less than 32 microinches and the surfaces have a smoothness of less than 40 microinches.

46. The mechanism of any one of claims 41, 42, and 43 wherein the flatness is less than 16 microinches and the surfaces have a smoothness of less than 20 microinches.

47. The mechanism of any one of claims 41, 42, and 43 wherein the flatness is less than 6 microinches and the surfaces have a smoothness of less than 5 microinches.

48. The mechanism of any one of claims 41, 42, and 43 wherein the coefficient of static friction of the surfaces is less than about 0.6.

49. The mechanism of any one of claims 41, 42, and 43 wherein the compressive strength of the components is greater than about 1900 MPa to greater than about 6,000 MPa.

50. The mechanism of any one of claims 41, 42, and 43 wherein the compressive strength of the components is greater than about 2,000 MPa.

51. The mechanism of any one of claims 41, 42, and 43 wherein the compressive strength of the components is greater than about 2,500 MPa.

52. The mechanism of any one of claims 41, 42, and 43 wherein the compressive strength of the components is greater than about 3,500 MPa.

53. The mechanism of any one of claims 41, 42, and 43 wherein the surfaces have a hardness of at least about 1400 kg/mm$^2$.

54. The mechanism of any one of claims 41, 42, and 43 wherein the surfaces have a hardness of at least about 1500 kg/mm$^2$.

55. The mechanism of any one of claims 41, 42 and 43 wherein the surfaces have a hardness of at least about 3,000 kg/mm$^2$.

56. The dynamic seal of any of one of claims 41 and 43, wherein the cooperating movable surfaces are advanced structural ceramic materials.

57. An apparatus for treating material with a fluid comprising:

(a) chamber means for a pressurized fluid for receiving material to be treated;

(b) dynamic seal means having cooperating movable surfaces for sealing the chamber while the chamber is pressurized that substantially prevents the leakage of fluid at the chamber means pressure of at least about 50 psig during movement of the surfaces for introducing material into and discharging material from the chamber means.

58. An apparatus for treating material with a fluid comprising:

(a) chamber means having a fluid environment at a controlled pressure condition for receiving material to be treated;

(b) dynamic seal means comprised of advanced structural ceramic materials having cooperating movable surfaces for sealing the chamber that substantially prevents the leakage of fluid at the chamber means pressure during movement of the surfaces for introducing material into and discharging material from the chamber means.

59. An apparatus for treating material with a fluid comprising:

(a) chamber means having a fluid environment at a controlled pressure condition for receiving material to be treated;

(b) dynamic seal means comprised of components having cooperating movable surfaces having a hardness of at least about 900 kg/mm$^2$ and a flatness of less than 70 microinches, the dynamic seal means sealing the chamber and substantially preventing the leakage of fluid at the chamber means pressure during movement of the surfaces for introducing material into and discharging material from the chamber means.

60. The apparatus of any one of claims 57, 58, and 59 wherein the smoothness of the movable surfaces is less than 70 microinches.

61. The apparatus of any one of claims 57, 58, and 59 wherein the flatness is less than 40 microinches and the surfaces have a smoothness of less than 32 microinches.

62. The apparatus of any one of claims 57, 58, and 59 wherein the flatness is less than 20 microinches and the surfaces have a smoothness of less than 16 microinches.

63. The apparatus of any one of claims 57, 58, and 59 wherein the flatness is less than 6 microinches and the surfaces have a smoothness of less than 5 microinches.

64. The apparatus of any one of claims 57, 58, and 59 wherein the coefficient of static friction of the surfaces is less than about 0.6.

65. The apparatus of any one of claims 57, 58, and 59 wherein the compressive strength of the components is greater than about 1900 MPa to greater than about 6,000 MPa.

66. The apparatus of any one of claims 57, 58, and 59 wherein the compressive strength of the components is greater than about 2,000 MPa.

67. The apparatus of any one of claims 57, 58, and 59 wherein the compressive strength of the components is greater than about 2,500 MPa.

68. The apparatus of any one of claims 57, 58, and 59 wherein the compressive strength of the components is greater than about 3,500 MPa.

69. The apparatus of any one of claims 57, 58, and 59 wherein the surfaces have a hardness of at least about 1,400 kg/mm$^2$.

70. The apparatus of any one of claims 57, 58, and 59 wherein the surfaces have a hardness of at least about 1,500 kg/mm$^2$.

71. The apparatus of any one of claims 57, 58, and 59 wherein the surfaces have a hardness of at least about 3,000 kg/mm$^2$.

72. The apparatus of any one of claims 57 and 59 where the cooperating movable surfaces are advanced structural ceramic materials.

73. The apparatus of any one of claims 57, 58, and 59 wherein the dynamic seal means includes a first dynamic seal for introducing material into the chamber and a second dynamic seal for discharging material from the chamber means.

74. The apparatus of any one of claims 57, 58, and 59 wherein the dynamic seal means includes at least one seal having cooperating movable surfaces of advanced ceramic structural materials.

75. The apparatus of any one of claims 57, 58, and 59 wherein the apparatus also includes means for introducing and removing fluid from the chamber means.

76. The apparatus of any one of claims 57, 58, and 59 wherein the chamber means includes an extract solvent inlet, and extract solvent outlet, means for maintaining extraction solvent at controlled pressure within the chamber, and extraction solvent recovery system for recirculating solvent on a continuous basis.

77. The apparatus of any one of claims 57, 58, and 59 wherein the chamber means includes an inlet for a controlled temperature bath, an outlet for a controlled temperature bath, and a source of fluid at a controlled temperature.

78. The apparatus of any one of claims 57, 58, and 59 wherein the dynamic seal means is capable of maintaining a pressure greater than 300 psig.

79. The apparatus of claim 58 or 59 wherein the dynamic seal means is capable of maintaining a pressure greater than about 50 psig.

80. The apparatus of any one of claims 57, 58, and 59 wherein the chamber means pressure is greater than about 1,500 psig.

81. The apparatus of any one of claims 57, 58, and 59 wherein the chamber means pressure is greater than about 2,000 psig.

82. Apparatus for treating tobacco material with a fluid comprising:

(a) means for loading tobacco material into a treatment chamber through aligned apertures in contacting surfaces of first and second plates, at least the contacting surfaces of the plates being sufficient to substantially prevent leakage of a fluid at pressures greater than about 50 psig, the first plate being fastened on its opposite side to a stationary supporting member and the second plate being fastened on its opposite side to a treatment chamber, the chamber being in fixed alignment with the aperture in the second plate;

(b) means for moving one plate relative to the other so that the apertures in the plates are no longer aligned and the contacting ceramic surface of the first plate covers the aperture of the second plate;

(c) means for introducing fluid into the closed chamber at a pressure greater than at least about 50 psig;

(d) means for moving one plate relative to the other so that the apertures in the plates are aligned; and (e) means for unloading treated tobacco material from the chamber.

83. Apparatus for treating tobacco material with a fluid comprising:

(a) means for loading tobacco material into a treatment chamber through aligned apertures in contacting surfaces of first and second plates, at least the contacting surfaces of the plates comprising advanced structural ceramic materials, the first plate being fastened on its opposite side to a stationary supporting member and the second plate being fastened on its opposite side to a treatment chamber, the chamber being in fixed alignment with the aperture in the second plate;

(b) means for moving one plate relative to the other so that the apertures in the plates are no longer aligned and the contacting ceramic surface of the first plate covers the aperture of the second plate;

(c) means for introducing fluid into the closed chamber;

(d) means for moving one plate relative to the other so that the apertures in the plates are aligned; and (e) means for unloading treated tobacco material from the chamber.

84. Apparatus for treating tobacco material with a fluid comprising:

(a) means for loading tobacco material into a treatment chamber through aligned apertures in contacting surfaces of first and second plates, at least the contacting surfaces of the plates having a hardness of greater than about 900 kg/mm$^2$ and a flatness of less than about 70 microinches, the first plate being fastened on its opposite side to a stationary supporting member and the second plate being fastened on its opposite side to a treatment chamber, the chamber being in fixed alignment with the aperture in the second plate;

(b) means for moving one plate relative to the other so that the apertures in the plates are no longer aligned and the contacting ceramic surface of the first plate covers the aperture of the second plate;

(c) means for introducing fluid into the closed chamber;

(d) means for moving one plate relative to the other so that the apertures in the plates are aligned; and (e) means for unloading treated tobacco material from the chamber.

85. Apparatus for treating tobacco material with a fluid under pressure comprising:

(a) means for loading tobacco material into a treatment chamber through aligned first apertures in contacting surfaces of first and second plates to which a clamping force is applied, the first plate being fastened on its opposite side to a stationary supporting member and the second plate being fastened on its opposite side to a movable treatment chamber housing, the chamber being held within the housing in fixed continuous alignment with the first aperture in the second plate;

(b) means for moving the housing in one direction so that the first apertures in the plates are no longer aligned and the contacting surface of the first plate covers the first aperture of the second plate sufficiently to form a seal;

(c) means for contacting the tobacco material with fluid at a pressure greater than at least 50 psig;

(d) means for applying at least a minimum clamping force to substantially prevent fluid leakage between the first and second plates while moving the housing in the same direction as in (b);

(e) means for removing pressurized fluid from the chamber to vent the chamber of pressurized fluid;

(f) means for aligning the chamber from which pressurized fluid has been removed with a second aperture in the first plate; and (g) means for unloading treated tobacco material from the chamber.

86. Apparatus for introducing tobacco material into and removing treated tobacco material from a treatment chamber containing a pressurized fluid comprising:

(a) means for loading tobacco material into a vessel through an aperture in a movable plate having opposed surfaces, the vessel being held on one surface of the movable plate in fixed alignment with the aperture;

(b) means for aligning the aperture in the movable plate with an aperture in a fixed plate having opposed surfaces, the aperture in the fixed plate communicating with a chamber for the treatment of tobacco material containing a pressurized fluid on one surface of the fixed plate, the fixed plate on its opposite surface being in continuous contact with at least a portion of the opposite surface of the movable plate, at least the contacting surfaces of the plates comprising advanced structural ceramic materials, and the vessel loaded with tobacco material communicates with the tobacco material treatment chamber;

(c) means for continuously applying at least a minimum compressing force to the plates to substantially prevent fluid leakage between the contacting surfaces of the plates so that the treatment chamber is continuously sealed against fluid leakage;

(d) means for discharging tobacco material from the vessel into the treatment chamber, whereby tobacco material is introduced into the treatment chamber;

(e) means for treating tobacco material with the pressurized fluid in the treatment chamber;

(f) means for discharging treated tobacco material from the treatment chamber into a vessel through aligned apertures in contacting surfaces of a fixed plate and a movable plate to which at least a minimum compressing force is applied to continuously provide a fluid-tight seal between the contacting surfaces of the plates, at least the contacting surfaces of the plates comprising advanced structural ceramic materials, the movable plate being fastened on its surface opposite the contacting surface to a vessel that is held in fixed alignment with the aperture, and the fixed plate being fastened on its surface opposite the contacting surface to the treatment chamber;

(g) means for moving the movable plate so that the apertures are no longer aligned and treated tobacco material can be discharged form the vessel, whereby treated tobacco material is removed from the treatment chamber; and (h) means for discharging treated tobacco material from the vessel.

87. A process for altering the character of a material, the process comprising the steps of:

(a) sealing a chamber with at least one dynamic seal having components providing cooperating movable surfaces for sealing the chamber and for introducing a material into and removing the material from the chamber; and then (b) introducing a fluid into the chamber at controlled conditions of pressure of at least about 50 psig; and then (c) moving at least one component of at least one seal, the seal substantially preventing leakage of fluid at a pressure of at least 50 psig; and then (d) introducing the material into the chamber; and finally (e) removing treated material from the chamber.

88. The process of any one of claims 1 through 3 and 9 through 14 and 87 wherein the fluid is an extraction solvent and the process includes the additional step of removing an extract-laden solvent separately from extracted material.

89. The process of any one of claims 1 through 3 and 9 through 14 and 87 wherein the material is tobacco material, the fluid is an extraction solvent and the process includes the additional step of removing an extract-laden solvent separately from extracted tobacco material.

90. The process of any one of claims 1 through 3 and 9 through 14 and 87 wherein the removed and treated tobacco material has at least one component extracted therefrom.

91. The process of any one of claims 1 through 3 and 9 through 14 and 87 wherein the material is tobacco material, the fluid is a tobacco material expansion agent, the treated tobacco material is a tobacco material impregnated with expansion agent, and the process includes the additional step of decreasing pressure on removing impregnated tobacco material to promote expansion of the impregnated tobacco material.

92. The process of any one of claims 1 through 3 and 9 through 14 and 87 wherein the material is tobacco material, the fluid is a tobacco material expansion agent, the treated tobacco material is a tobacco material impregnated with expansion agent, and the process includes the additional step of applying heat on removing the impregnated tobacco material to expand the tobacco material.

93. The process of any one of claims 1 through 3 and 9 through 14 and 87 wherein the material is a tobacco material, the fluid is a reactant, and the treated material is a modified tobacco material.

94. The process of any one of claims 1 through 3 and 9 through 14 and 87 wherein the material is a biological material and the process includes the additional step of controlling pressure conditions on removing treated biological material having fluid impregnated in the cells thereof to promote disruption of the cells of the material.

95. The process of any one of claims 2, 3, 10, 11, 12, 13, 14 and 87 wherein pressure conditions are controlled at a pressure of at least about 350 psig.

96. The process of any one of claims 2, 3, 10, 11, 12, 13, 14 and 87 wherein pressure conditions are controlled at a pressure of at least about 450 psig.

97. The process of any one of claims 2, 3, 10, 11, 12, 13, 14 and 87 wherein pressure conditions are controlled at a pressure of at least about 1,100 psig.

98. The process of any one of claims 2, 3, 10, 11, 12, 13, 14 and 87 wherein pressure conditions are controlled at a pressure of at least about 1,500 psig.

99. The process of any one of claims 2, 3, 10, 11, 12, 13, 14 and 87 wherein pressure conditions are controlled at a pressure of greater than about 2,000 psig.

* * * * *